US005507485A

United States Patent [19]

Fisher

[11] Patent Number: 5,507,485

[45] Date of Patent: Apr. 16, 1996

[54] GOLF COMPUTER AND GOLF REPLAY DEVICE

[75] Inventor: Donald Fisher, Roslyn, N.Y.

[73] Assignee: Roblor Marketing Group, Inc., New York, N.Y.

[21] Appl. No.: 234,420

[22] Filed: Apr. 28, 1994

[51] Int. Cl.[6] ..... G01S 5/14; A63B 71/06; G09B 19/22

[52] U.S. Cl. ..... 273/32 R; 273/32 H; 364/410

[58] Field of Search ..... 364/410, 411, 364/412; 273/32 R, 32 H

[56] References Cited

U.S. PATENT DOCUMENTS

| | | | |
|---|---|---|---|
| 3,898,437 | 8/1975 | Butler . | |
| 4,367,526 | 1/1983 | McGeary et al. . | |
| 4,419,655 | 12/1983 | May . | |
| 4,764,666 | 8/1988 | Bergeron | 235/380 |
| 4,910,677 | 3/1990 | Remedio et al. . | |
| 5,043,889 | 8/1991 | Lucey | 364/412 |
| 5,095,430 | 3/1992 | Bonito et al. . | |
| 5,127,044 | 6/1992 | Bonito et al. . | |
| 5,245,537 | 9/1993 | Barber . | |
| 5,261,820 | 11/1993 | Slye et al. | 364/410 |
| 5,271,034 | 12/1993 | Abaunza . | |
| 5,319,548 | 6/1994 | Germain | 364/410 |
| 5,326,095 | 7/1994 | Dudley | 273/32 R |
| 5,364,093 | 11/1994 | Huston et al. | 273/32 R |

FOREIGN PATENT DOCUMENTS

| | | |
|---|---|---|
| 3134715 | 6/1991 | Japan . |
| 2249202 | 4/1992 | United Kingdom . |
| 9312439 | 6/1993 | WIPO . |

*Primary Examiner*—Jeffery Brier
*Attorney, Agent, or Firm*—Abelman, Frayne & Schwab

[57] ABSTRACT

A portable computer to facilitate the game of golf is programmed to record a golfer's score and keep track of various shots and the results of related wagering. Based upon such data and data regarding the layout of the golf course, the computer can provide real time recommendations for club selection as well as providing a summary of the results of a round of golf. Also, the computer can receive global positioning system (GPS) signals to locate a golf ball within a golf course.

54 Claims, 21 Drawing Sheets

GOLF COMPUTER AND GOLF REPLAY DEVICE

FIELD OF THE INVENTION

The present invention relates generally to computer type electronic devices to assist in playing the game of golf and, in particular, to such a device including means responsive to course position, as well as weather and climate conditions, to provide improved graphical course display, game recording, and replay features, including historical review and analysis of the individual player's performance. Further, the present invention relates generally to electronic devices that incorporate means to monitor games that supplement the game of golf, for example, keeping track of various betting games that golfers engage in while playing golf, and various provisions for keeping track of golf tournament play and competition, for example, match play and multiple round events.

BACKGROUND OF THE INVENTION

It is important in the game of golf to be able to accurately judge the distance to the hole. Knowing this distance enables the player to choose the appropriate club. Two frequently encountered problems that degrade a golfer's performance are: (i) inaccurate knowledge of the pertinent distance, and (ii) lack of information about the golfer's own past performance in a similar circumstance. As a result of either or both of these circumstances, the golfer will frequently over-club or under-club the shot.

In contrast with other sports, proper club selection rather than the amount of force applied plays a critically important role in proper ranging on the golf course. In other words, a properly taught golfer swings consistently and uniformly, varying the distance principally by proper club selection, and only occasionally by utilizing a shortened swing. Also, a problem exists with respect to compensating for other environmental conditions, such as wind and temperature, and also, the particular pin and tee placement in effect on any given golf course on any given day. Finally, many other factors complicate the process of golfing. For example, wagering or betting may accompany golfing, thereby creating distractions that can degrade performance. Also, such wagering or betting can even lead to disputes with fellow golfers if not properly accounted for—thus accounting for even more degradation in the play of golf. Also, during tournament play, the audience who is only able to view one hole at a time may wish to track a particular golfer's performance by looking at a scoreboard that is automatically updated on a shot-by-shot basis, so that results can be known even before the golfer completes the round. This is particularly important in those competitive golfing events where the "honor" system is employed, and score keepers do not monitor the play of golf. Also, the performance of opponents (either within or not within a golfer's own foursome) can create pressure. For example, in tournament play, if an adversary has already finished a round of golf, a particular golfer may need to perform at a certain, predetermined level in order to win. Also, golfers often become forgetful about past performance on the golf course—not able to remember how their own best previous results were obtained. For example, a golfer may not be able to recall what club produced favorable results in similar or identical circumstances now presented to that golfer. Also, during practice sessions, golfers need to know what shots are their weakest, so that they know what to emphasize during practice.

Prior Art Golf Computer Devices

A variety of devices for assisting a player's performance on a golf course appear in the prior art. These generally include range-finder type devices which are capable of measuring, with varying degrees of accuracy, the distance to a given object, such as a flag pole or "pin". These "visible rangefinding" devices typically require that the flag pole or pin be visible to the golfer from the current position of the ball. Thus, they are not effective if the flag pole or pin is not visible.

Other prior art rangefinding devices utilize the flag pole or pin as a reflector of, or receiver for, electro-magnetic signals. For example, the flag pole might be used to reflect or repeat a signal pulse.

Still other prior art devices require that golfers consult course maps and make "on the spot" distance calculations—many of which are complicated and imprecise.

Many other prior art devices include expensive and complex devices which utilize sensors which are installed beneath the fairway turf. For example, by installing such sensors at ten yard intervals, a golf cart can be outfitted with a device to track its position in relation to the features of a golf course. Such a method is costly, particularly due to the environmental conditions that the buried equipment is exposed to, given the fact that people and vehicles are constantly passing over them. Also, various portable devices are available to record, manipulate, and display golfer performance information, however, these devices do not provide any distance tracking capability, and are only responsive to number of shots taken, and so forth.

U.S. Pat. No. 3,898,437 shows a golf cart with a built-in yardage indicator to indicate the approximate distance travelled from the tee-off point. Also, U.S. Pat. No. 4,367,526 shows a hand-held golf calculator which a player can use to keep score and which may contain data on the course, the identification of players and contest arrangements.

U.S. Pat. No. 4,419,655 shows an electronic display device containing pictorial presentations of each hole with electronic indicators showing special features that are of interest to the players.

U.S. Pat. No. 5,127,044 discloses a cart-installed golf computer which includes a transferable memory device—e.g., a "smart card", floppy disk or the like—for transferring scoring data to a clubhouse-based handicap recording system.

U.S. Pat. No. 5,095,430 discloses a cart-installed golf computer which displays geographic features of the course and a light pen locator device. The '430 device further includes a physically transferable programmable memory device for storing players' scores, handicaps and bets, and transferring the data to a central computer.

U.S. Pat. No. 4,910,677 discloses a golf computer for generating, storing and retrieving golf data for a plurality of players on several different golf courses. It utilizes a cursor as a locator device.

U.S. Pat. No. 5,245,537 discloses a performance statistics device having a portable movement measurer, a microprocessor, a memory, an input keypad and a display output. The '537 device also includes a data base—located on a non-portable computer system—that contains reference coordinates for each hole on the golf course and every significant hazard. The data base contains certain past performance player information for each member player. The individual player selects a portable distance tracking device and receives downloaded, updated, current topographical data from the base computer's data base of the course he or she is to play, including his own personal past performance record. After initializing the portable distance tracking device at the number one tee, the movement measurer—in particular, accelerometers—keep track of the player's position throughout the play of the ball. As a result, at every position on the golf course the player is provided with an ability to determine the exact distance from the ball to any identifiable hazard and/or the hole in question. As information is inputted to the portable device, a record of clubs used and distance obtained is generated so that proper club selection for the distance involved becomes a matter of mechanical recommendation of the device.

While the aforementioned references describe a variety of portable golf computer devices, none of these references discloses a cart-mounted golf computer having means for automatically ascertaining the position of the cart on the course and for automatically updating the geographic display accordingly. Moreover, none of the aforementioned prior art devices include the graphical display set forth herein, whereby the individual's golf round can be virtually replayed and club selection optimized after the fact. Also, the prior art fails to incorporate into said golf computer wage and betting and score card reporting capabilities, which are essential for competitive or tournament play, respectively. Still further, no prior art golf computer includes means for receiving climate (i.e., temperature and humidity) as well as weather (i.e., wind speed and direction) conditions and utilizing such information in the computation of club selections or recommendations (e.g., recommendations based on the individual player's past performance when in a similar position, on a shot-by-shot or course-by-course basis), or the computation and recording of scores, bets and handicaps. Further, while several of the prior art golf computers include transferable memories for retaining a player's previous scores, shot distances, handicaps, etc., no prior art device includes a means for storing the entire game, so as to permit the player to "replay" the game on a clubhouse or home based video display. Still further, while prior art golf computers provide limited graphical displays of the course, none of the prior art devices provide multiple, selectable views of each hole, including bird's eye and straight ahead views of the entirety of the hole and the approach to the green, as well as a detailed view of the green, including its topographical features such as slopes.

SUMMARY OF THE INVENTION

One object of the present invention is an improved golf computer that includes one or more of the desirable features not provided by any prior art golf computer.

Another object of the present invention is a golf computer which includes means for automatically locating the position of the cart and/or golfer at any position on any hole or within any golf course. In addition, the golf computer advantageously includes means responsive to said position location for automatically updating the computer's graphical display to show the geographical features of immediate interest to the golfer.

Yet another object of the present invention is a golf computer which includes means for receiving and displaying weather and climate conditions (including, for example, wind speed and direction and temperature). In addition, the golf computer advantageously includes means responsive to said received conditions—as well as the golfer's location and the topography of the course—for computing club selections and recommendations, taking all factors into account simultaneously, including tee and pin (or flag) placement on any given course on any given day.

Still another object of the present invention is a golf computer which includes means for recording details of the golf game sufficient to permit later replay and analysis of the game. In addition, the invention advantageously includes means for permitting replay and analysis of the recorded game on a clubhouse or home based video display.

A still further object of the present invention is a golf computer which includes means for providing multiple, selectable views of each hole, including bird's eye and straight ahead views of the entirety of the hole and the approach to the green, as well as a detailed view of the green, including its topographical features such as slopes.

Yet still another object of the present invention is a home-based means for replaying recorded golf games, and for analyzing the player's performance statistics.

Still another object of the invention is an apparatus and method for suggesting shot and/or club selections to the golfer. Preferably, said apparatus and method for suggesting employ artificial intelligence and/or fuzzy logic techniques, and are responsive to (i) the golfer's position, (ii) weather and climate conditions, (iii) the layout of the hole, (iv) the golfer's stroke capabilities (as "learned" from previous shots made by that golfer with particular clubs and various conditions), and (v) the golfer's history on the particular hole (also "learned" from previous games).

Still another object of the invention is and apparatus and method for keeping track of other associated games that the golfers may be simultaneously engaged in while playing a round or tournament of golf, including betting (wagering and results), ranking of a series of golfers or foursomes during tournament play over single and multiple rounds of golf, number of shots above or below par, number of shots per hole, handicap, and any other statistic or gaming related to the play of golf. In particular, the invention can be adapted to provide a complete accounting system that any golfer may use to keep track of winnings (per course, per hole, against certain players, in certain weather, etc.).

Another object of the invention is to have a golf computer that is completely interactive with the actual golfer, on an individual basis. In that manner, the golf computer contemplated by the present invention can serve as a personal advisor while the golfer playing a round of golf, can replay a round of golf after the golfer has completed a round, and further, can serve as a golf coach by directing the golfer to practice certain shots with particular clubs, and perhaps even under certain conditions and on certain holes. By maintaining a database indicative of a golfer's historical performance on a hole-by-hole, club-by-club basis, the golfer can ascertain what results are most likely obtainable given a particular "lie" (that is, the calculated position of the golf ball on a golf course), and more importantly, given the parameters of the particular hole, such as distances, climate, pin placement, etc., the proper club can be selected by a particular golfer. All of this can be accomplished automatically, thereby minimizing and/or eliminating the need for human intervention into the golf "caddie" function, to the extent the "caddie" would be called upon to render advice as to which club to swing for any particular shot. Finally, in particularly suited circumstances, like during a competitive round of golf, the golf computer can be instructed to play risks in a certain manner, given a particular golfer's performance. For example, if in tournament play, a golfer must score a "birdie" or better in order to win the tournament, the golf computer can formulate the best way to win, that is, for example, the computer may decide that given a particular golfer's level of skill, the golfer should try to either "drive the ball" directly to the green, loft the ball over the corner of a "dog-leg", etc. Thus, it is contemplated that a golf computer according to the present invention can serve all club and swing advisory functions previously served by live golf "caddies".

The above, as well as other, objects and advantages of the present invention are achieved by an improved golf computer apparatus and method for operating such apparatus, as depicted in the drawings and described with reference to a presently preferred embodiment and various optional features and extensions.

BRIEF DESCRIPTION OF THE DRAWINGS

The present invention is depicted in the following set of drawings, in which.

DETAILED DESCRIPTION OF THE INVENTION

Figure 1:
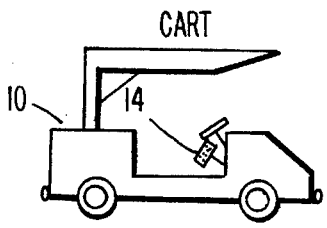
FIG. 1 depicts the mounting of the cart-based golf computer on a golf cart.

Reference is now made to FIG. 1, which depicts the mounting of the cart-based golf computer 14 on a golf cart 10. Cart 10 is used by golfers to move about the golf course.

Figure 2:
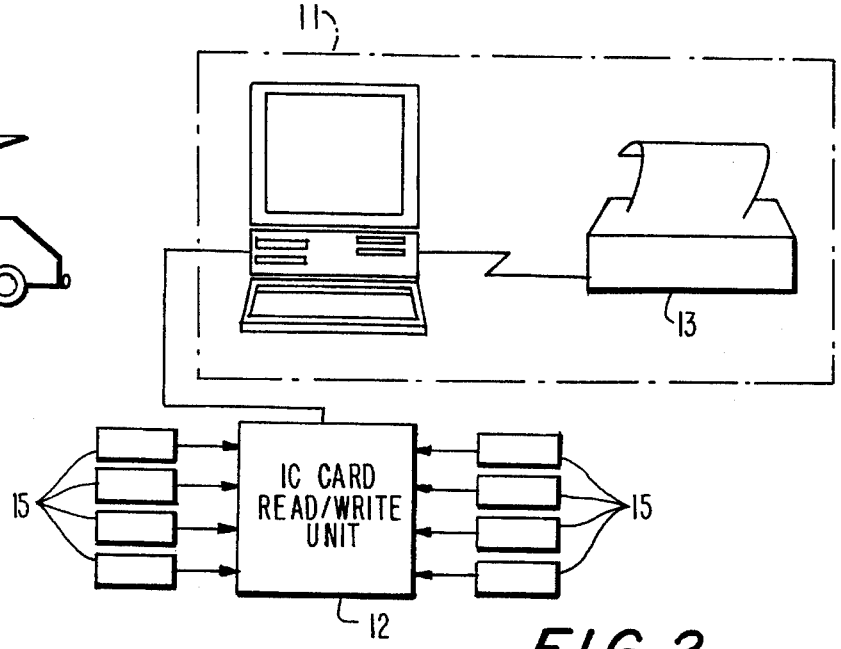
FIG. 2 depicts the clubhouse-based host computer for use in conjunction with the golf computer.

Reference is now made to FIG. 2, which depicts the clubhouse-based host computer 11 for use in conjunction with the golf computer 14. Host computer 11 can be suitable for driving display electronics (not shown) so that golfers at the club house location (or off site) can keep track of the golf results of the user of golf computer 14 on a real time basis. Furthermore, host computer 11 can be interfaced with printer 13 to print out golf score results, including golf scores, a shot-by-shot analysis (including an analysis of poor shots (sliced, hooked or under hit), and the results of simultaneous games played during the round of golf, including betting and wagering, tournament performance, and so on. As shown in FIG. 2, integrated circuit ("IC") card units 15 (also, referred to herein as transferable memory cards) are inserted into the host computer 11, having previously been interfaced to golf computer 14. Hence, the information about golfer performance can be stored on IC cards 15, which are interchangeable between host computer 11 and golf computer 14. Also, the IC cards 15 serve an additional purpose, being to customize golf computer 14 by supplying course data, such as the pin and tee placement for that day, information about course conditions or any other information that the golf computer 14 is to be responsive to. Naturally, it is contemplated that radio frequency luminescent radiation or other wireless energy transfer means can be used to link the golf computer 14 with the host computer 11, to either supplement or replace IC cards 15.

Figure 3:
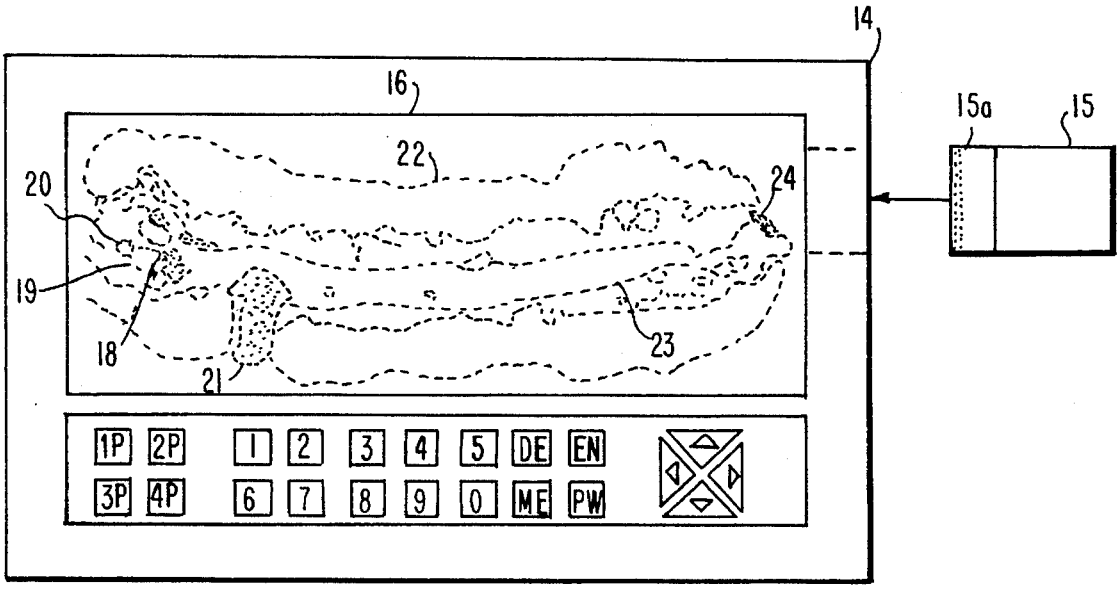
FIG. 3 shows a front view of the cart-based golf computer.

Reference is now made to FIG. 3, which shows a front view of the cart-based golf computer 14. IC card 15 with connecting means 15*a* is inserted into golf computer 14. Display means 16, which can be any type of display such as a cathode ray tube, liquid crystal display, or the like, displays the actual golf course hole 22. Hole 22 has a tee area 24, a fairway 23, water hazard 21, sand trap 18 and green 20. Further, keypad 17 with numerical input means (including cursor pointing means) are used to activate the display means 16. It is contemplated that optionally, an interactive display and input device, such as the NEWTON™, a product of the Apple Computer Company, can be utilized as a display means 16 and input means 17, for example.

Figure 4A:
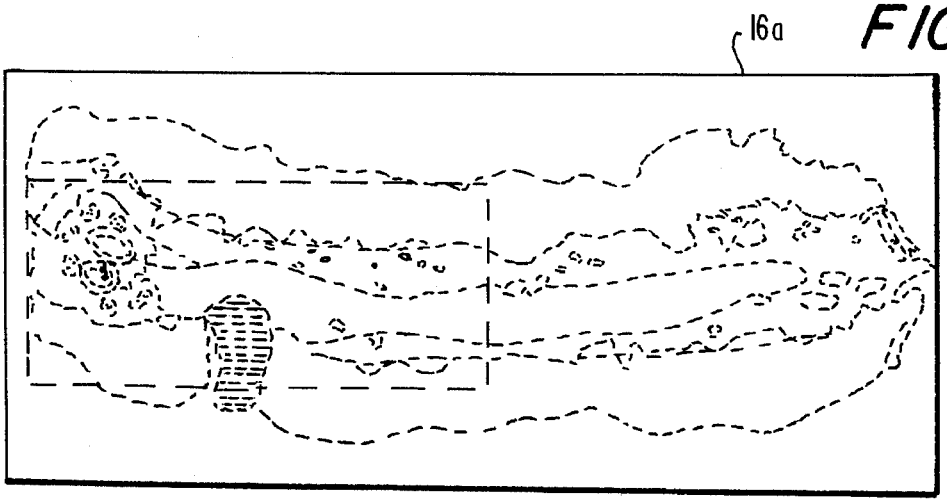
FIGS. 4*a*–4*c* depict three bird's eye view options—(a) entirety, (b) approach-shot or (c) green—for displaying the layout of each hole on the golf computer.
Figure 4B:
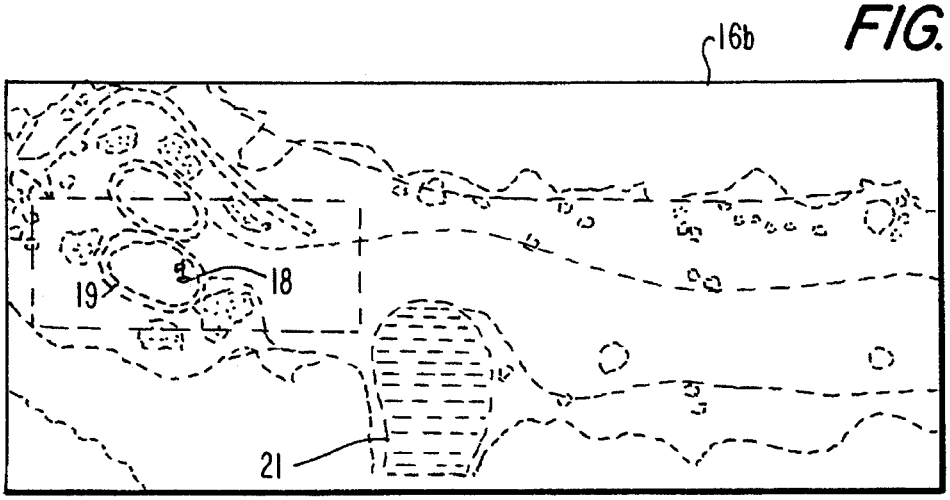
Figure 4C:
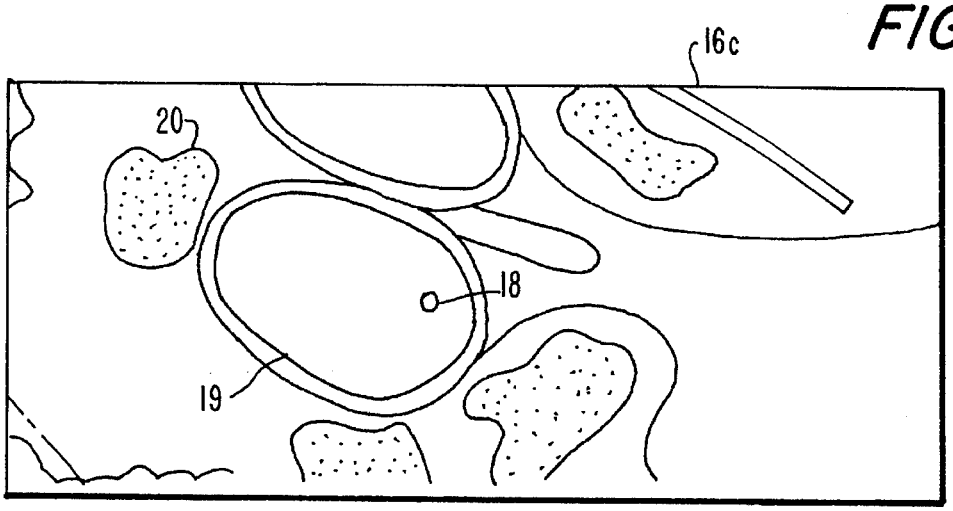

Reference is now made to FIGS. 4*a*–4*c*, which depict three bird's eye view options—(a) entirety 16*a*, (b) approach-shot 16*b* or (c) green 16*c*—for displaying the layout of each hole on the golf computer. By having at least three discrete display views, the golfer can more easily visualize only those obstacles ahead of him enroute to the hole. For example, when a golfer is approaching a green 19, the exact placement of the hazard (such as trap 20 or pond 21) is critically important. The golfer must at all times select clubs and attempt shots that are least likely to fall within such hazards. On the other hand, once the golfer has reached the green 19, the placement of such hazards (that is, any course features behind the golfer, that the golfer has already traversed) is not important. Therefore, the maximum benefit of the display means 16 can be attained by only displaying at any given instant that which the golfer is immediately concerned with in order to direct the golfer directly to the hole.

Figure 5:
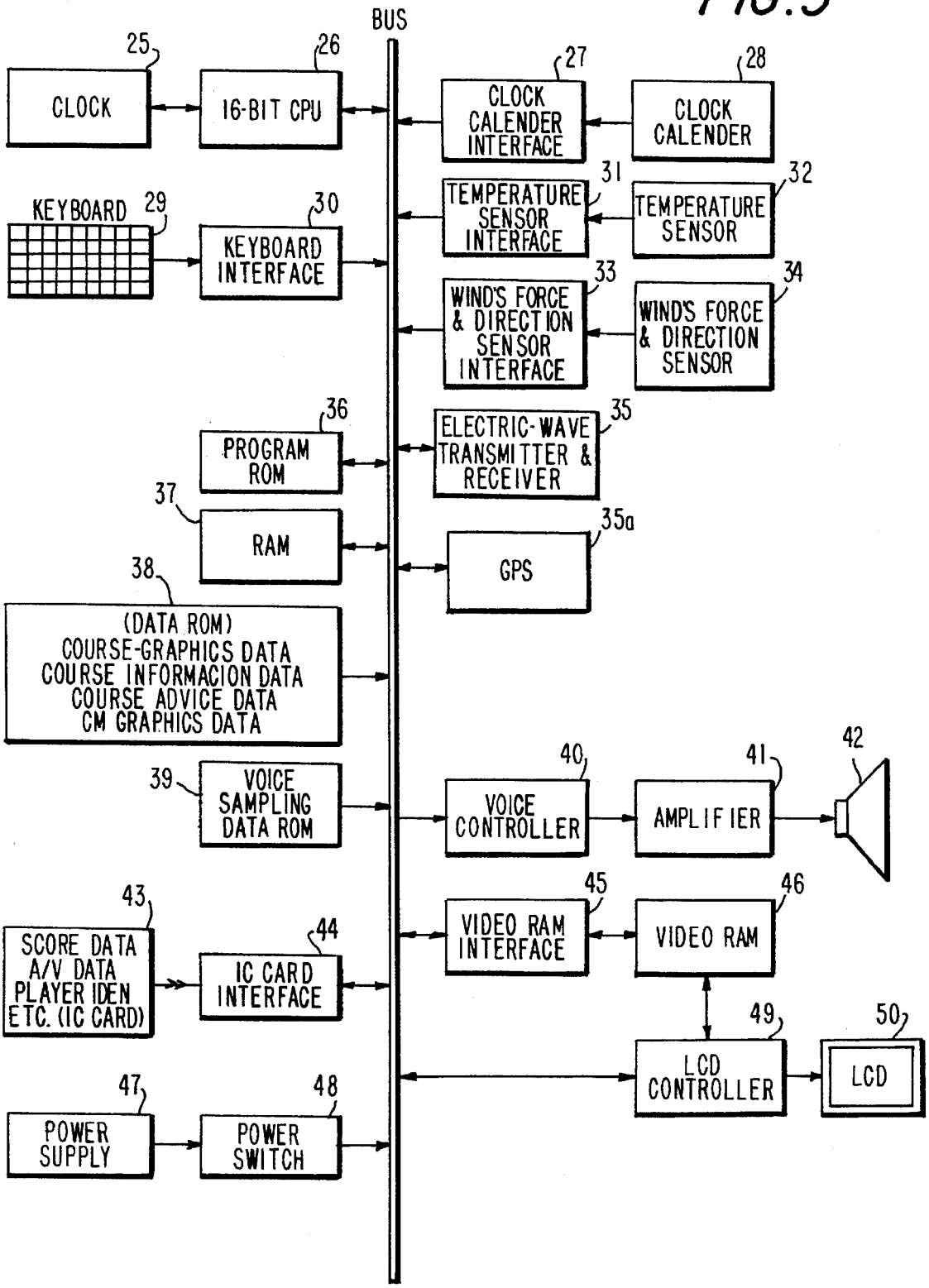
FIG. 5 is a functional block diagram of the cart-based golf computer.

Reference is now made to FIG. 5, which is a functional block diagram of the cart-based golf computer. Clock 25 and central processing unit 26 cooperate to move data along the data bus as shown. Keyboard 29 and its interface 30 are input devices, to allow the golfer to input data onto the data bus. Memory elements (for example, program read-only-memory 36, random access memory 37, data memory (which can be ROM, RAM, or any other suitable memory) 38, and voice memory 39) allow the golf computer to intelligently accept instructions from the golfer, and in turn, provide advice to the golfer and keep track of events related to the game of golf. The golf computer can "speak to" the golfer via voice controller 40, amplifier 41 and loudspeaker 42. By storing an appropriate directory of phonemes in voice memory 39, voice controller 40 (which consists of, for example, a digital to analog converter) can replicate sounds to communicate to the golfer. Likewise, the golf computer can display visual images to the golfer via video interface 45, video memory 46, screen controller 49 and display 50. In that manner, display 50 (for example, a liquid crystal display) can serve as the display means 16, shown in FIG. 3. Power supply 47 and switch 48 supply power to the golf computer 14. Also shown is a clock and calendar circuit (27 and 28), and temperature monitors (31 and 32) and weather sensors 33 and 34, for use in determining the course conditions. Transferable memory module 43 and its interface 44 are used to enter player data into the golf computer 14. Of course, any variety of data entry means can be used to enter course or player data into the golf computer 14, such as electromagnetic radiation or other radio or telephone systems (shown as transmitter/receiver device 35), all of which are well known in the art. Finally, GPS (Global Positioning System) unit 35*a* can be used by golf computer 14 so that the golfer need not enter his position on the course, with that task attended to automatically by the GPS unit 35*a*, in combination with the golf computer 14.

Figure 6:
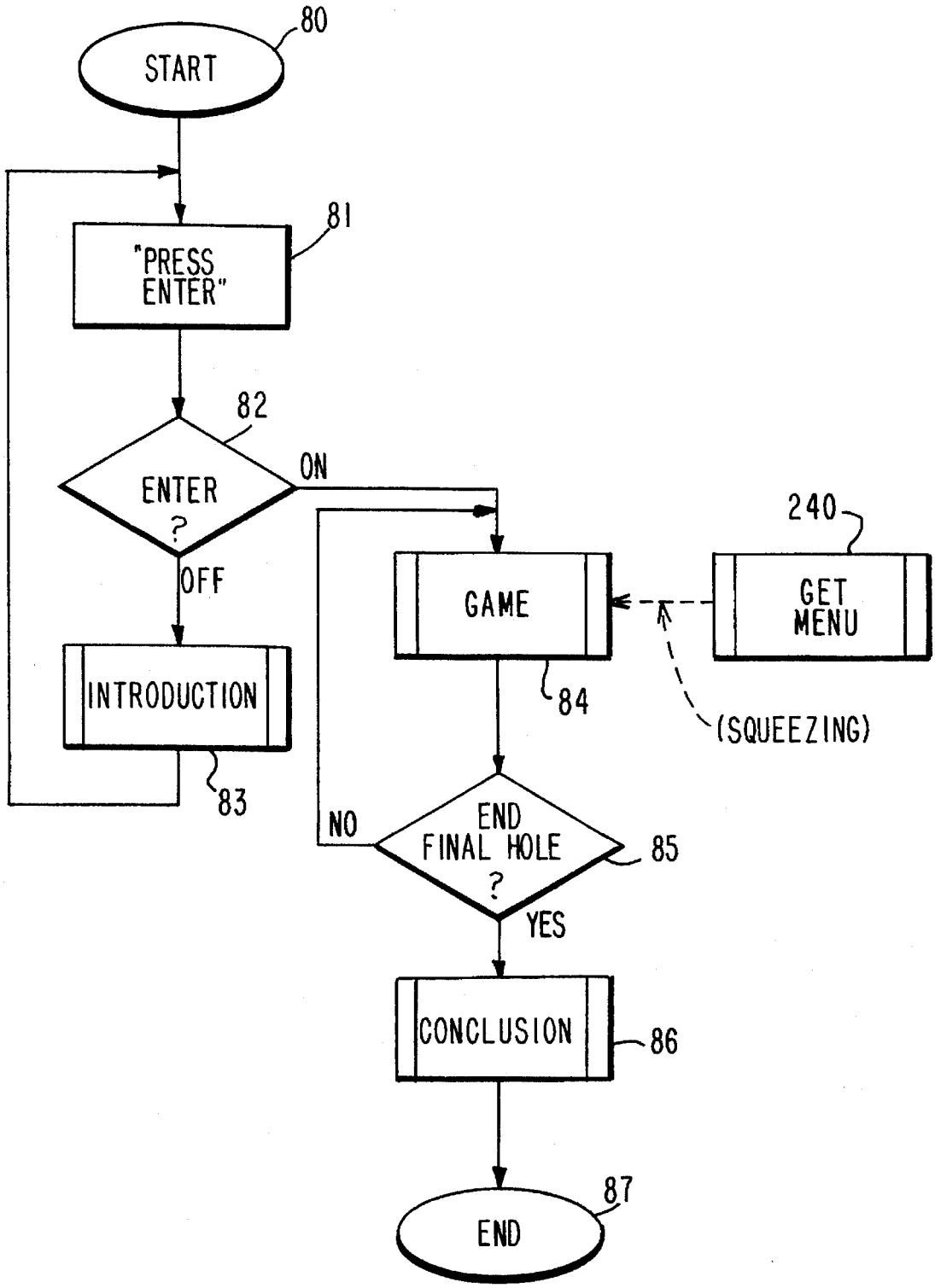
FIGS. 6–12 are flowcharts showing the operation of the cart-based golf computer during a golf game.
Figure 7:
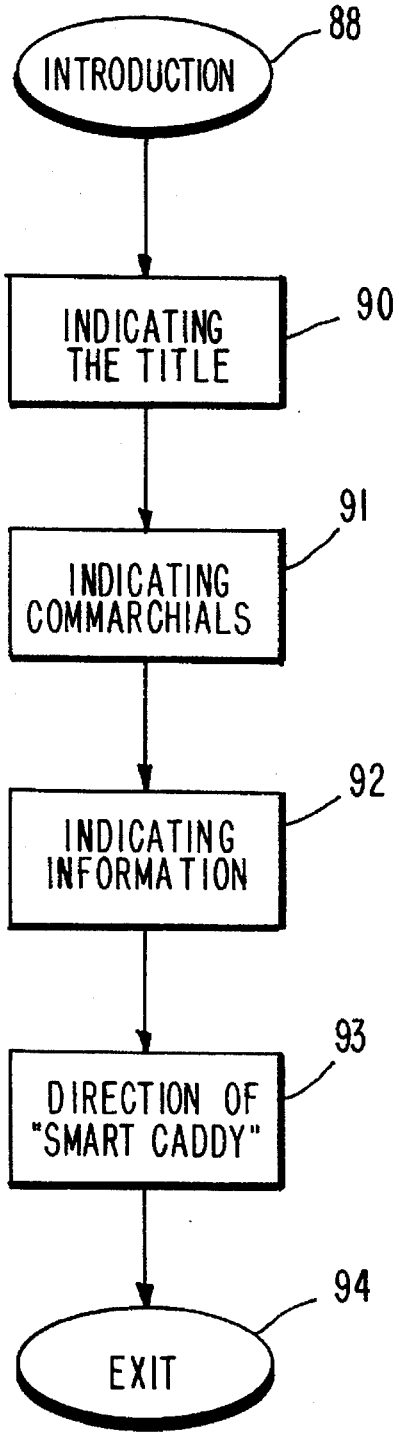

Reference is now made to FIGS. 6–12, which are flowcharts showing the operation of the cart-based golf computer during a golf game. FIG. 6 shows a start state 80, wherefrom the golfer presses the enter key 81. The game 84 has a menu routine 240 which guides the golfer through the operation of the golf computer 14, and a final hole evaluation step 85 determines whether the game has been completed to provide an input to 86. Data entered at 82 can also be used to activate an introduction routine 83. FIG. 7 indicates the title 90 of the golf computer 14, and any commercials 91 that are to be displayed. Other golfer information 92 is displayed, and directions 93 can be provided.

Figure 8:
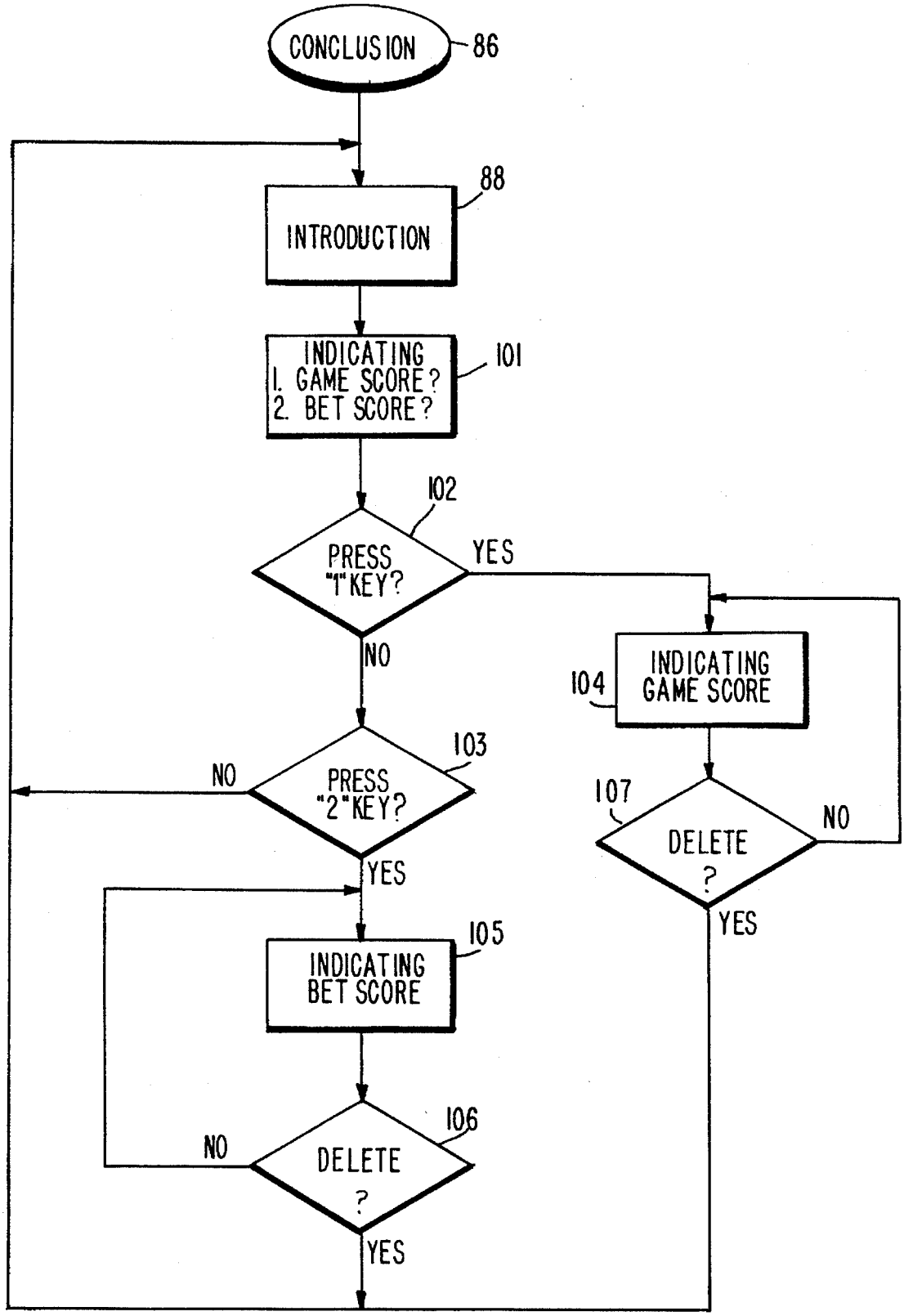
Figure 9:
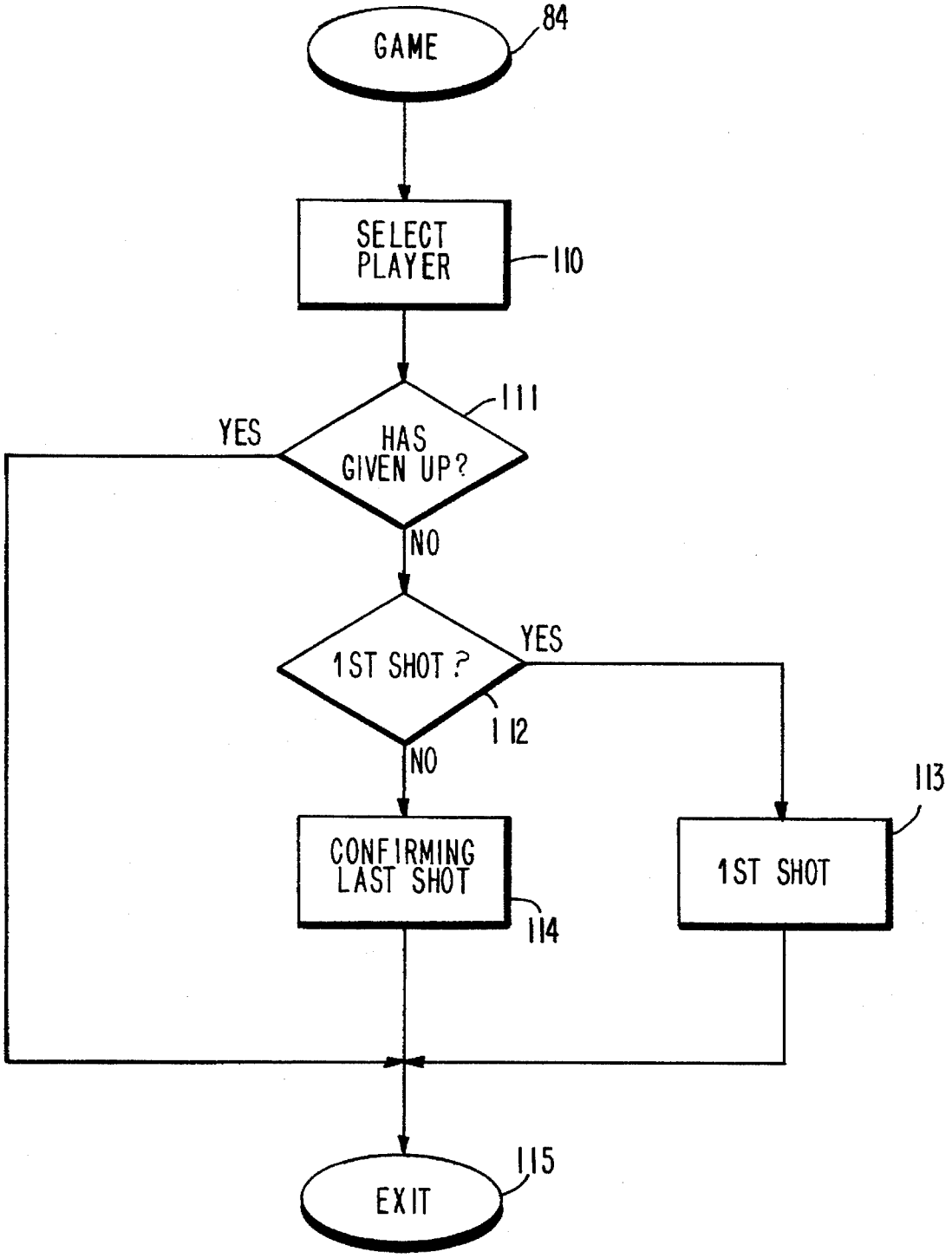

FIGS. 8 through 12 depict the software that controls the computer control system of FIG. 5. Specifically, the software enables the keyboard 29 and keyboard interface 30 to communicate along bus 31*a* of FIG. 5, so that all input and output devices are controlled so as to permit the golf computer 14 to perform its intended functions. Referring to FIG. 8, the user is queried 101 as to which scores should be displayed. Response 102 causes display 104 of game scores to remain on the screen, until the player requests 107 another function. Similarly, response 103 initiates display 105 of bet scores, which remain on the screen until cleared 106 by the player. By entering the correct, predetermined series of key strokes (or correctly pointing a cursor control device, such as a mouse or a light pen), the golf computer 14 can be placed into various modes, to facilitate the game of golf. For example, a betting mode can be entered, wherein the money won and lost by each player is tracked and accumulated, so that at the end of the round of golf, payments can be exchanged between the participants. These results can be stored in memory, so that historical betting performance (based on any number of variable, including climate, course, hole, etc.) can be recorded for future reference. Of course, at any point, a printer 13 (or a printer located at the golf computer 14) can be used to print the golf results (for example, betting, shots taken, performance, etc.). FIG. 9 shows the operation of a player select menu. Once a player is selected 110—and assuming the player has not given up 111—program flow is directed 112 to either a first shot routine 113 (discussed in regard to FIG. 10) or a confirming last shot routine 114 (discussed in regard to FIG. 11).

Figure 10:
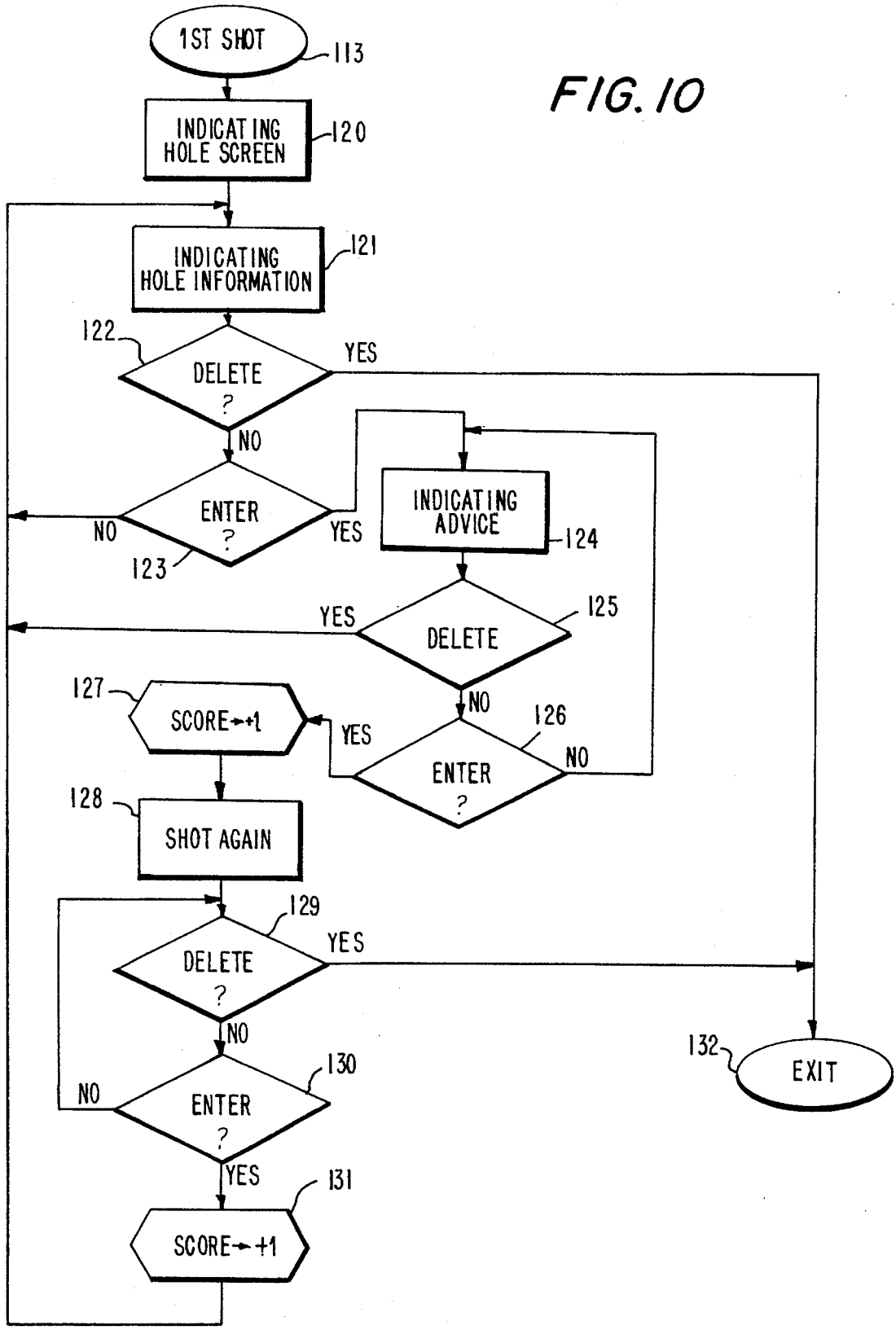

FIG. 10 depicts the flow of a first shot routine 113. The golf computer depicts 120 and, as needed, updates 121 information regarding the present hole. The player may exit 132 the routine at steps 123 or 129. Otherwise, advice 124 is provided, and the player traverses through states 125–126 to take his/her first shot. The golf computer updates 127 with the player's score to reflect the shot and, using states 128–131, permits the player to take additional shots.

Figure 11:
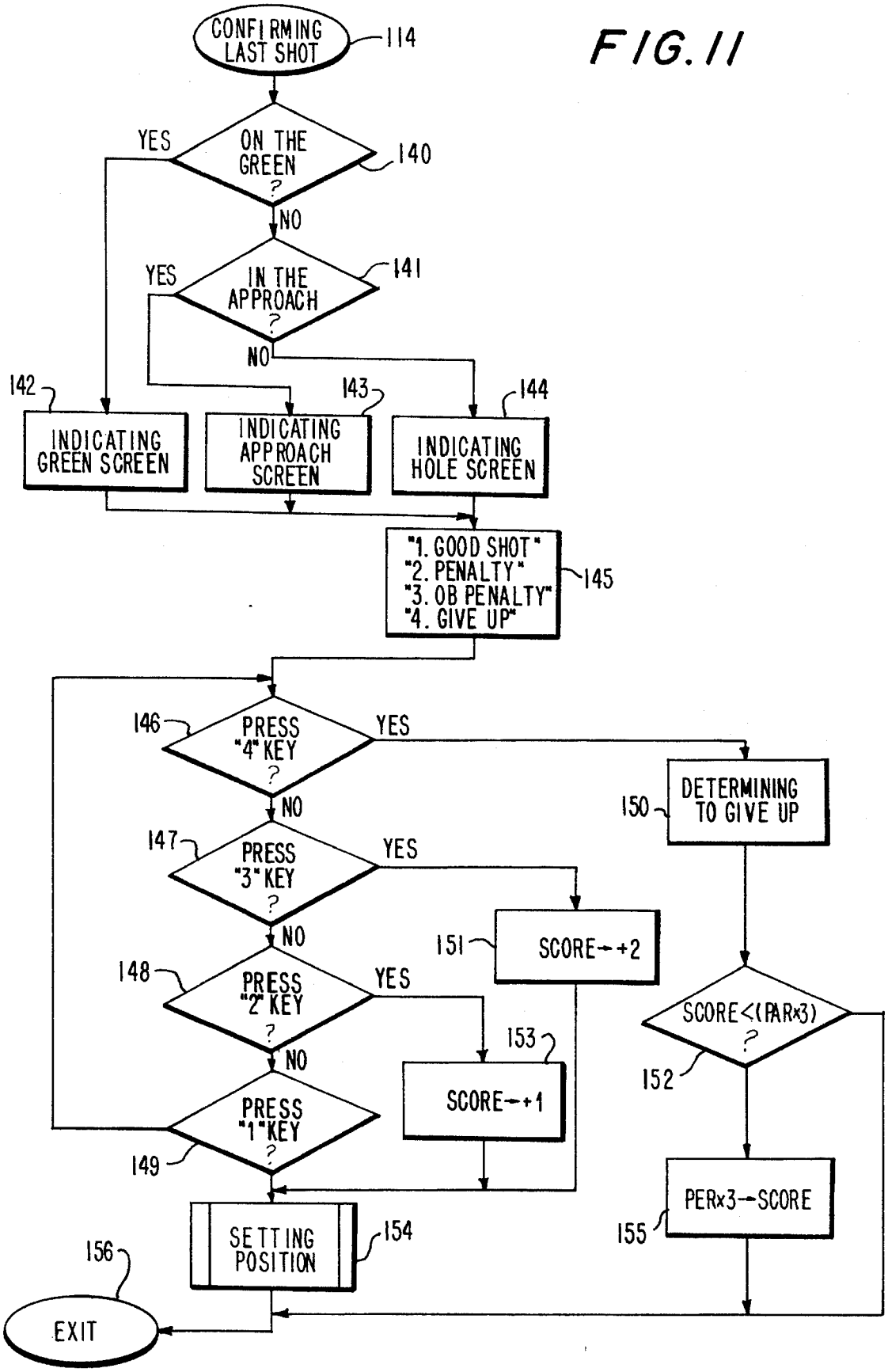

FIG. 11 depicts the last shot confirming routine 114. Depending on the result of a position query 140, the golf computer displays either the green screen 142, approach screen 143 or hole screen 144. In response to a player selection made in states 145–149, the golf computer will either:

(i) determine that the player has given up 150 and add three times the hole par 152 to the player's score 155;

(ii) add one stroke to the player's score 153, and update the present position 154;

(iii) add two strokes to the player's score 151, and update the present position 154; or (iv) complete 149 the hole and update the present position 154.

Figure 12:
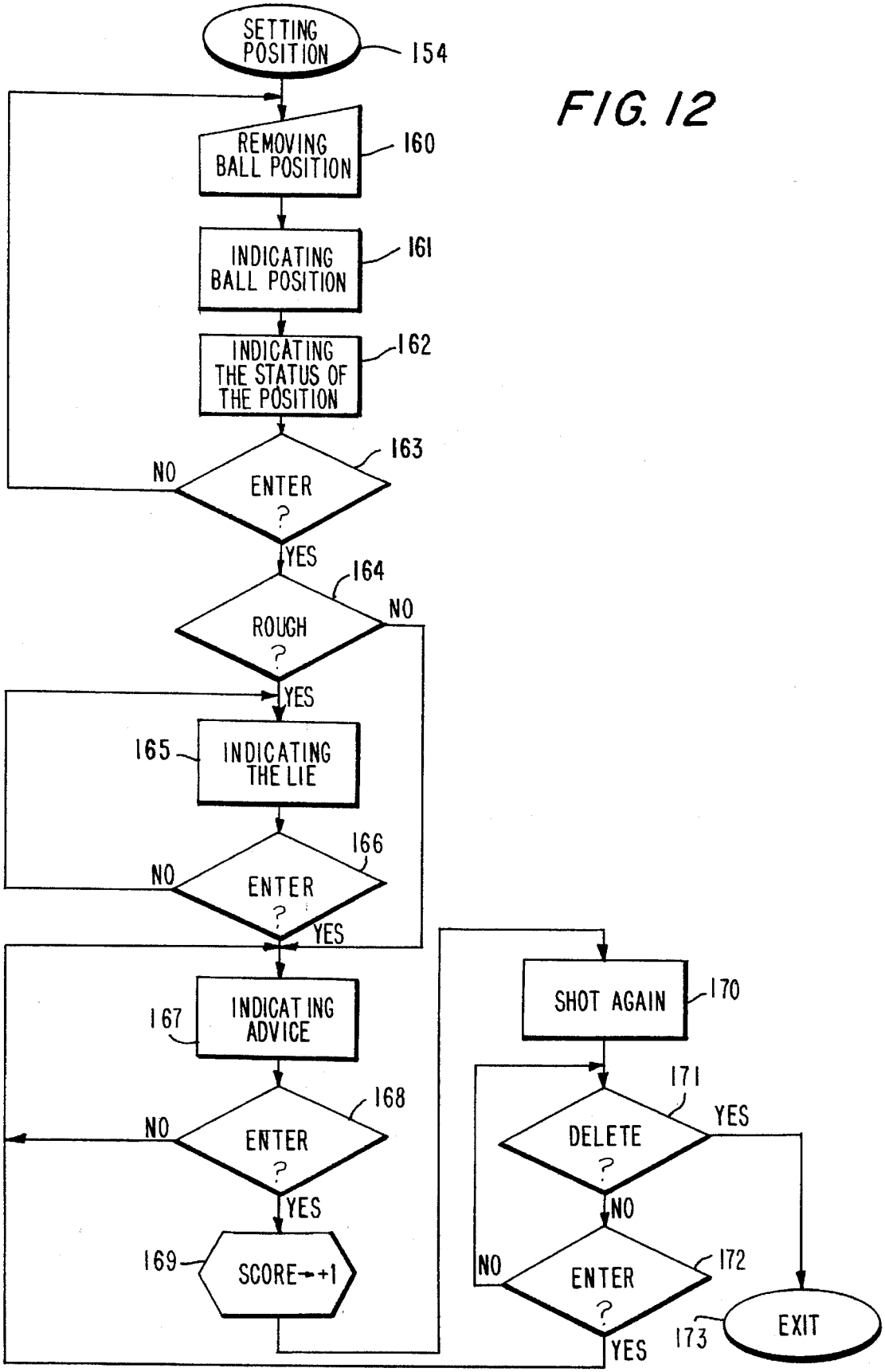
Figure 13:
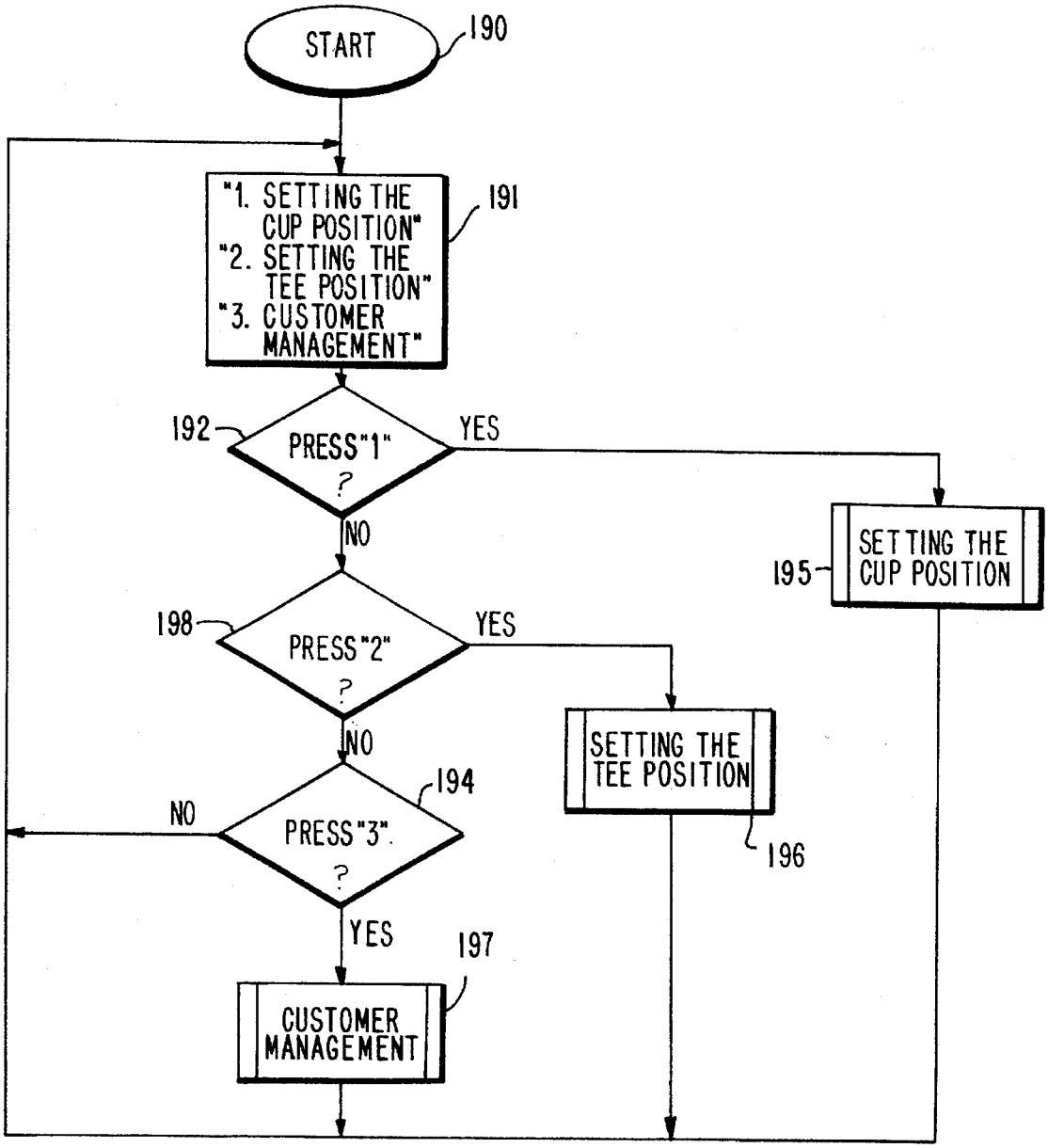
FIGS. 13–18 are flowcharts showing the operation of the clubhouse-based host computer.

The position setting routine 154 of FIG. 12 commences by removing 160 the present ball position, indicating 161 the new position and the status 162 of that position. As needed 163, the computer may determine 164 that the ball in the rough and, in response, indicate 165 the lie, as needed 166. Alternatively, the golf computer will indicate 167 current advice and, as needed 168, update 169 the player's score and direct 170 the player to shoot again. Dependent upon the results of the next shot, the computer will either return 172 to step 167 or proceed 171 to step 173. Of course, the flow depicted in FIGS. 10 and 11 can be modified in any manner desired, depending upon the golf games, scoring methods, betting methods, or the like, desired.

Figure 14:
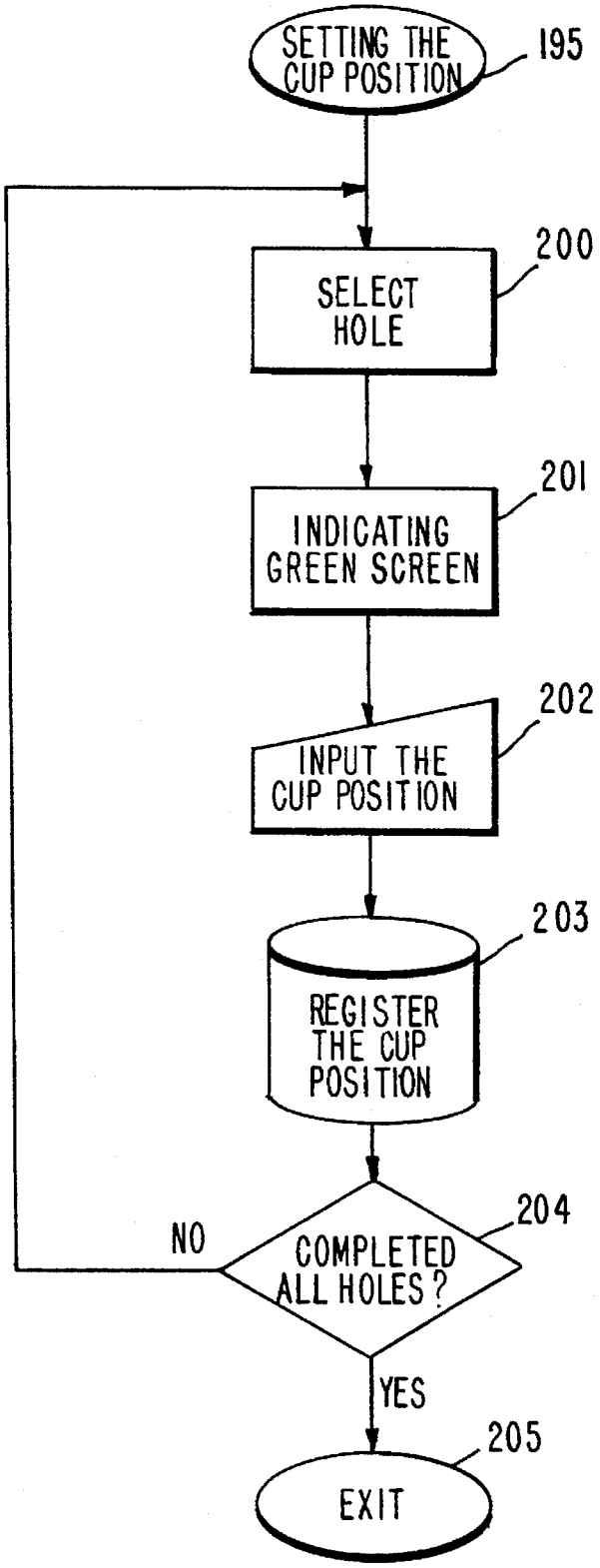
Figure 15:
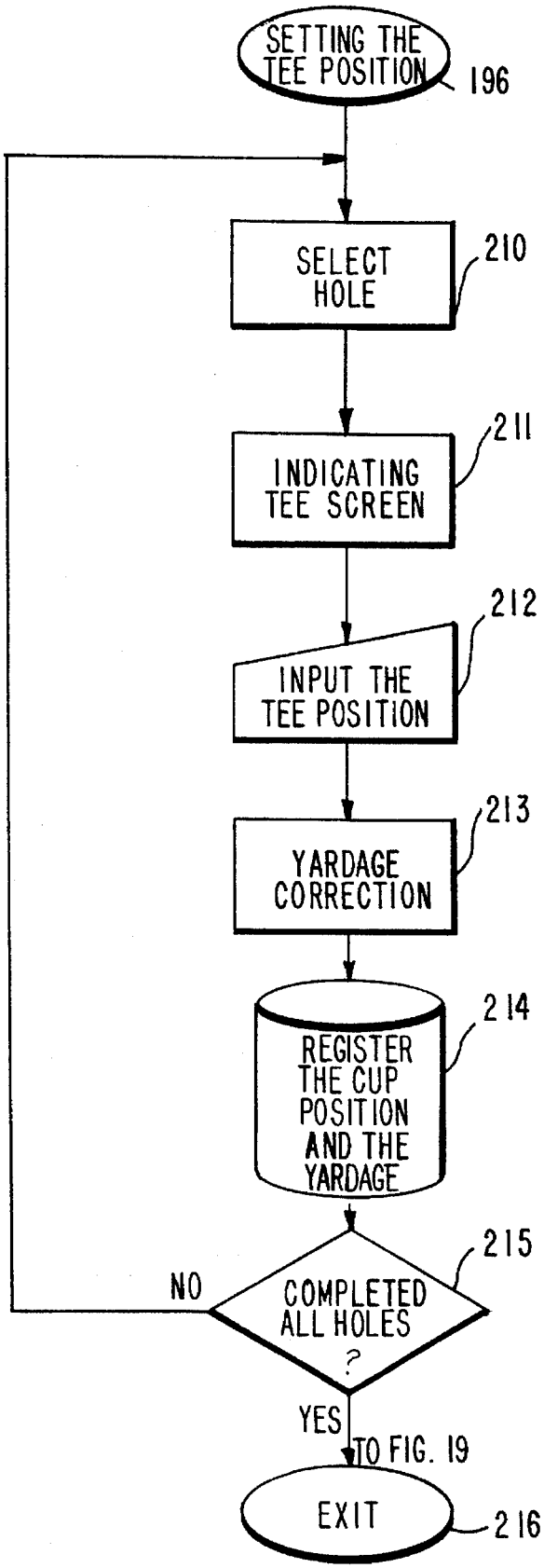
Figure 16:
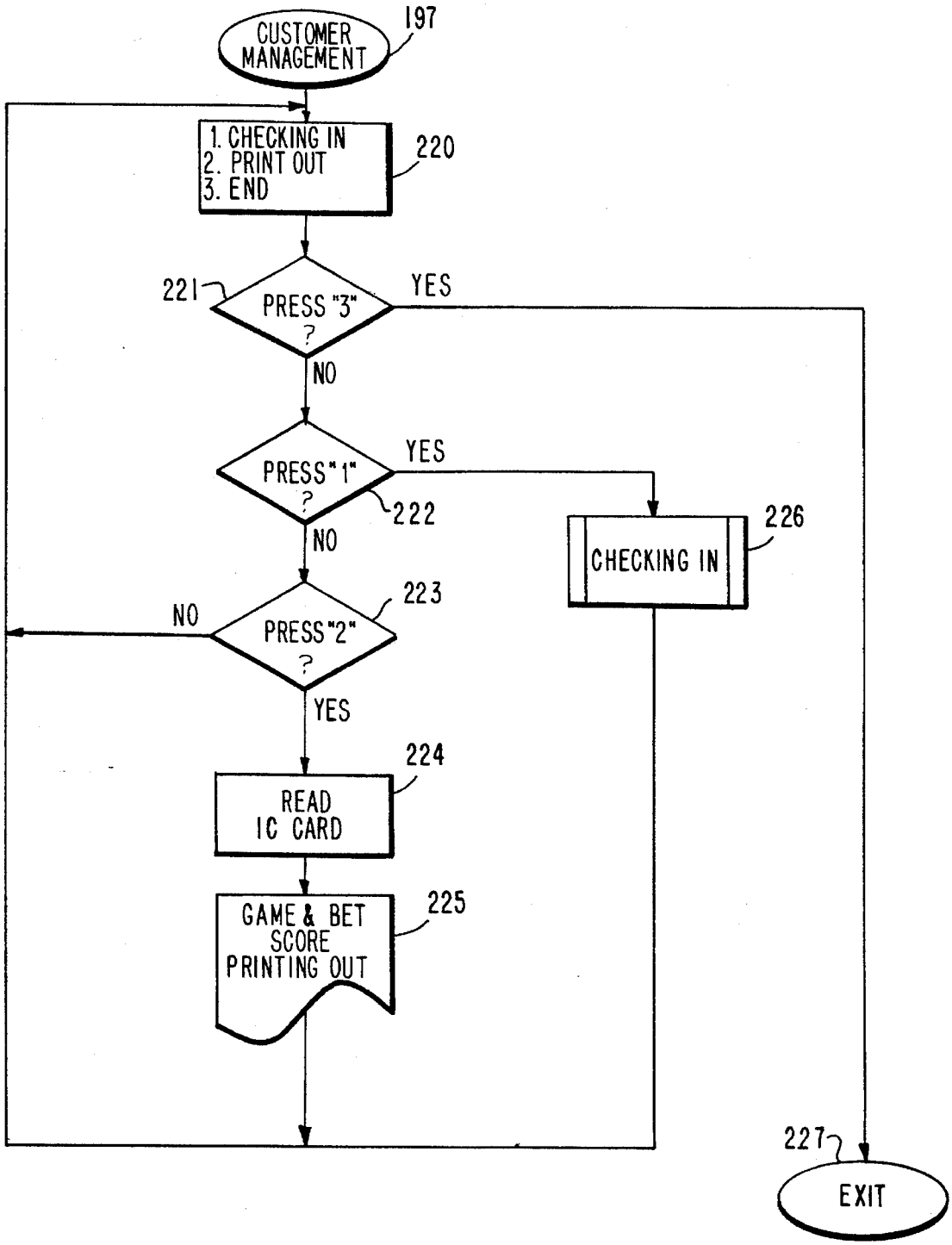

Reference is now made to FIGS. 13–18, which are flowcharts showing the operation of the clubhouse-based host computer. Beginning from the start state 190 of FIG. 13, and dependent upon the selection in states 191–194, the host computer performs one of the following functions:

(i) setting 195 the cup position (as described in regard to FIG. 14);

(ii) setting 196 the tee position (as described in regard to FIG. 15); or (iii) customer management functions 197 (as described in regard to FIG. 16).

As depicted in FIG. 14, setting 195 the cup position involves, for each hole 204, performing the following steps: selecting 200 a hole; indicating 201 the appropriate green screen; inputting 202 the cup position; and registering 203 the cup position.

As shown in FIG. 15, setting 196 the tee position involves, for each hole 215, performing the following steps: selecting 210 a hole; indicating 211 the appropriate tee screen; inputting 212 the tee position; performing 213 yardage correction; and registering the cup position and the yardage.

Figure 17:
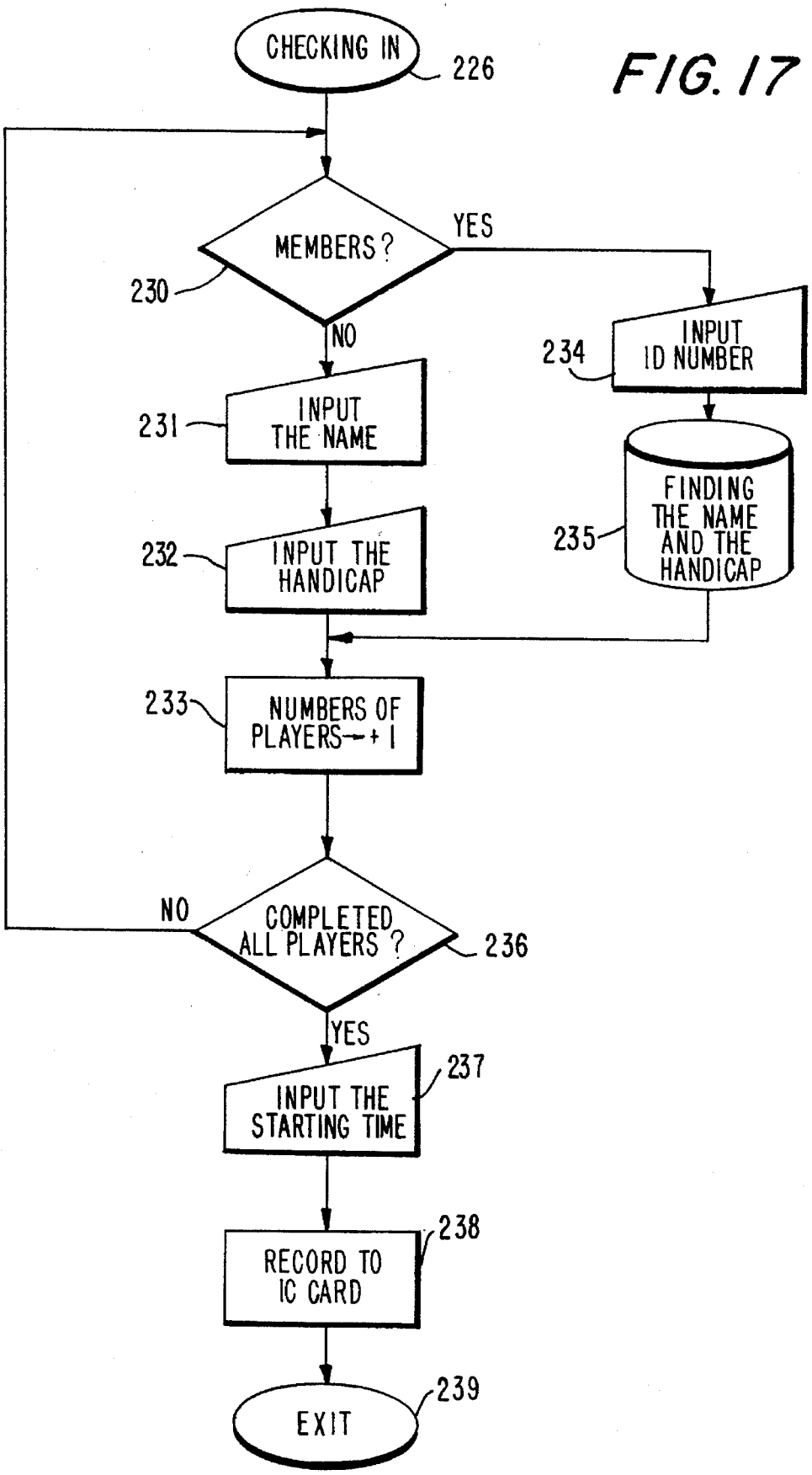

As shown in FIG. 16, customer management 197 involves selecting—in steps 220–223—and performing one of the following functions:

(i) checking in 226 (as described in regard to FIG. 17);

(ii) reading 224 the IC card (or other transferable memory), and printing out 225 the game and bet scores; or (iii) returning 227 to start state 190.

As shown in FIG. 17, checking in 226 involves, for each player 236, determining 230 whether the player is a member: if so, the player's ID number is input 234 and used to locate 235 the player's name and handicap; if not, the player inputs 231–232 his/her name and handicap. Once the player input is completed 236, the starting time is input 237 and recorded 238 on the IC card.

Figure 18:
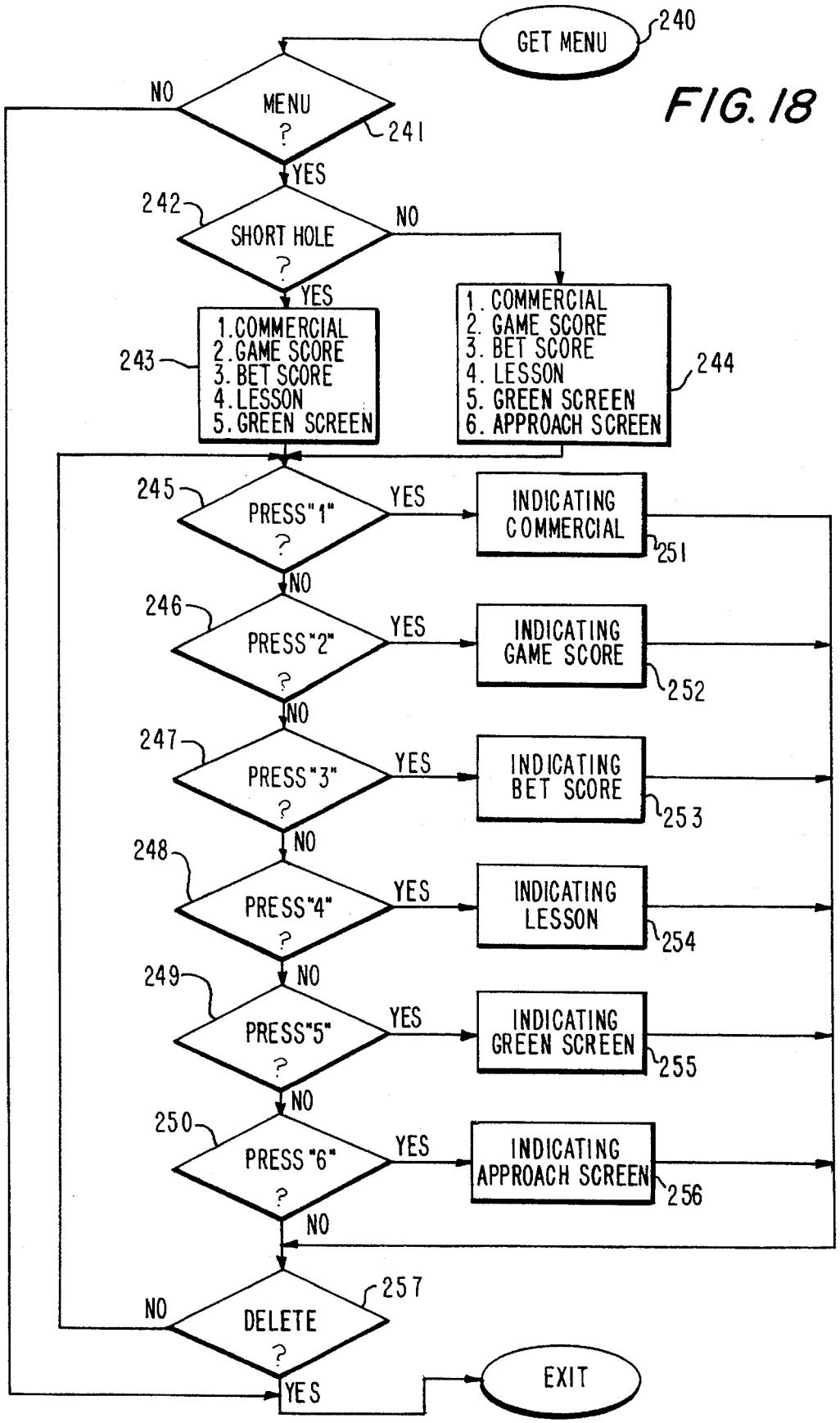

FIG. 18 shows the get menu 240 routine, which—in steps 241– 250—selects one of the following functions to be performed:

(i) indicating 251 a commercial;

(ii) indicating 252 the game score;

(iii) indicating 253 the bet score;

(iv) indicating 254 a lesson;

(v) indicating 255 a green screen; or (vi) indicating 256 an approach screen.

Figure 19:
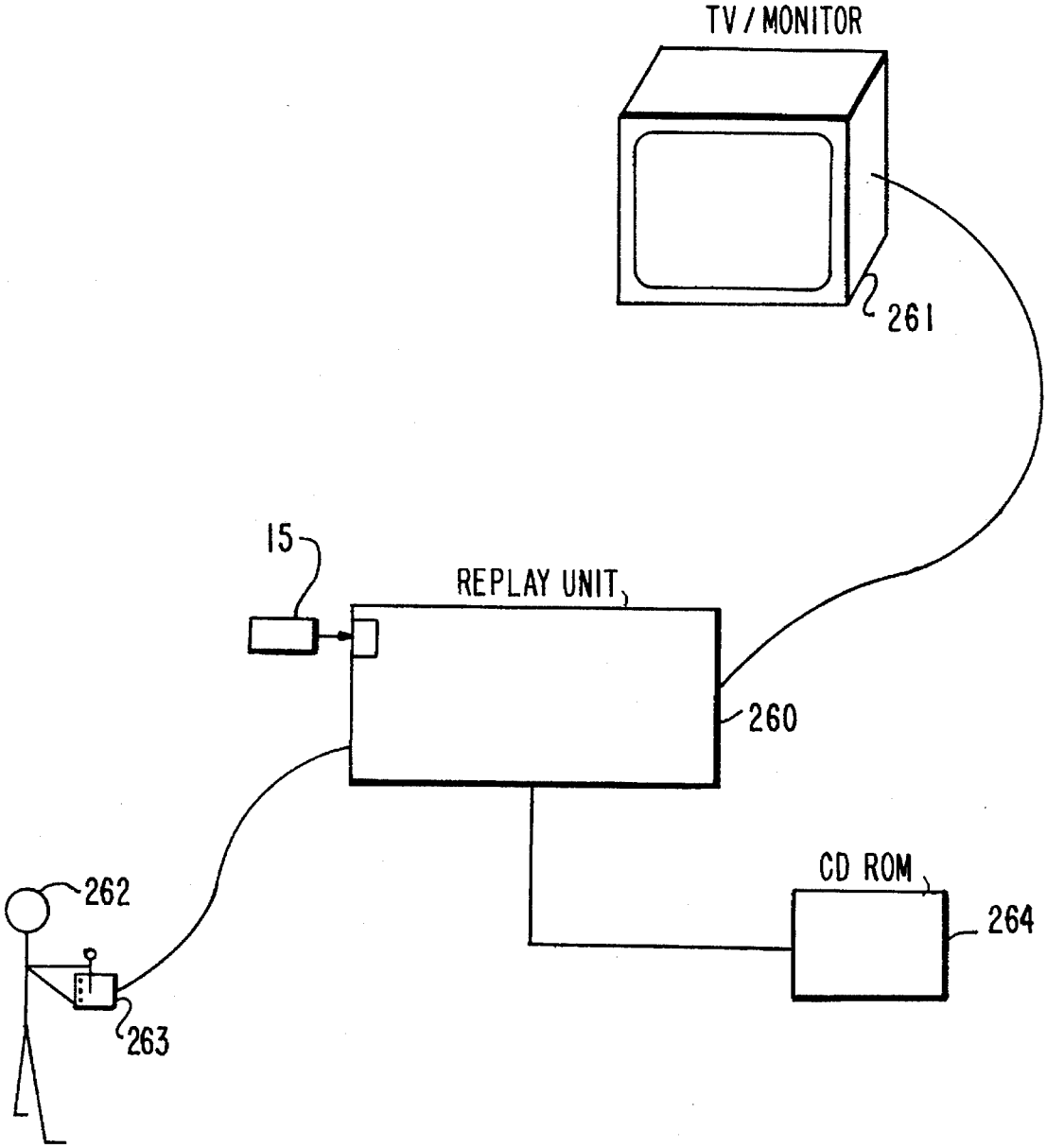
FIG. 19 depicts a home-based replay unit for use in conjunction with the golf computer of the present invention.

Referring now to FIG. 19, depicted therein is a home-based replay unit 260. The player 262 inserts a transferable memory module 15—which stores the golfer's playing history—into replay unit 260, thereby permitting the replay unit to replay actual golf games as well as to allow player 262 to play hypothetical games (i.e., "video game" type golf) utilizing a hypothetical golfer—displayed on television monitor 261—with the same stroke capabilities as those of the actual player 262.

Transferrable memory module 15 may have limited storage capacity. In order to provide a visually rich and detailed representation of the golf course on screen 261, replay unit 260 preferably includes, or operates in conjunction with, a CD ROM player 264. CD ROM player 264 provides replay unit 260 with the graphical information needed for generating visually realistic images of the course from either the golfer's perspective (the straight ahead view) or from above (the bird's eye view).

Video games which use an auxiliary CD ROM player for this purpose—i.e., enhancing background graphics—are presently available from manufacturers such as Atari, Sega and Nintendo. In addition, personal computers equipped with CD ROM drives are well suited for use as a home-based replay unit. Accordingly, replay unit 260 may be implemented using a variety of widely available video game or personal computer devices.

During use, player 263 controls replay unit 260 through an input device 263—such as a joystick or a mouse—and views the responses from the replay unit on screen 261. A variety of menus, displayed on screen 261, guide the user in selecting the desired operating mode for replay unit 260.

Figure 20:
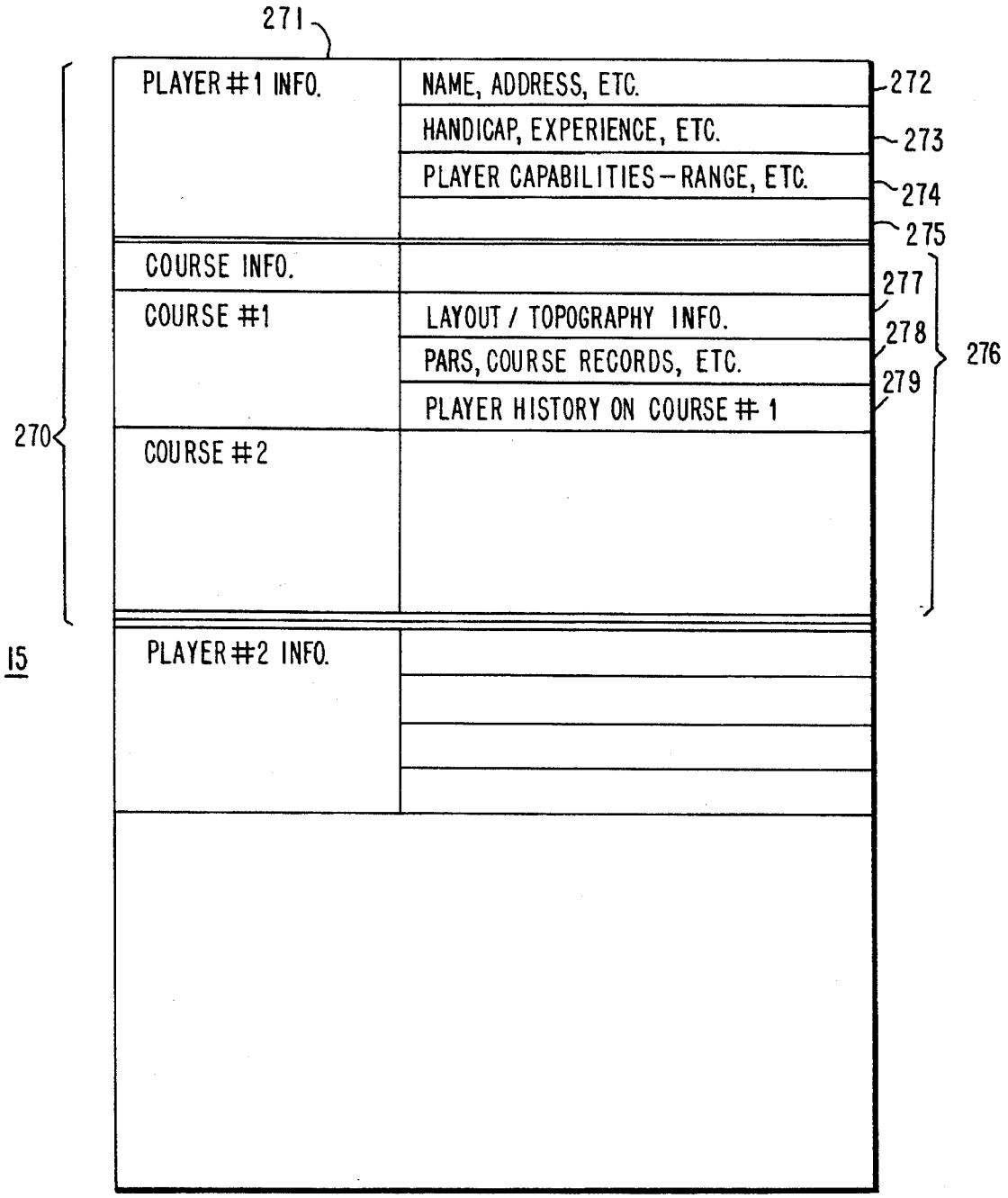
FIG. 20 is a memory map showing the information stored in the transferable memory module used to record golf scores and strokes.

Reference is now made to FIG. 20, which depicts an exemplary memory map showing the various types of information stored in transferable memory module 15. Each memory module 15 may contain records for one or more players; one such player record 270 is depicted in FIG. 20. Optionally, a centralized golfer database can be established for golfers. Such a database could be accessed in any number of ways, including via the public telephone network. In that case, all golfer data could be available to the golfer instantaneously, obviating the need for memory cards that a golfer must take with him to a golf course. In that case, a golfer would simply access his golf files, which would be downloaded into the golf computer 14, so that golf computer 14 can be programmed to be responsive to that particular golfer's needs, taking into account his past performance in various golfing situations. Thus, the golf computer 14 can become the perfect "caddie", has it will never forget the level of skill of the player. The golf computer can tell the golfer to use a particular club from a particular position, and even inform the golfer of his percentage of past success at similar shots. Further, the golf computer can analyze trends, by informing a golfer that a particular shot needs work, as it was, for example, "better last year", and getting "worse lately". By employing artificial intelligence (AI) methodology, the golf computer can even be adapted to forecast results, and to propose alternatives for a golfer, for example, "don't try to drive the ball over that lake—lay up in front, and drive directly to the green on your next shot". Thus, the golf computer in providing the calculated position of the golf ball can become a powerful golfing aid for golfers of any level of skill.

Each player record 270 includes a player information portion 271, which contains information about the player and those aspects of his/her golfing history that are independent of the particular course(s) on which the games were played. Player information portion 271 preferably includes:

(i) personal information 272, including the name, address, age, membership status, etc. of the player;

(ii) handicap information 273; and (iii) player capability information 274, including regularly updated information about the player's range and consistency for each club and/or stroke— such information being used to suggest clubs and/or strokes during play.

Each player record 271 further includes a course information portion 276, which stores information about the player's history on various courses and attempts at various shots. In particular, for each course on which the player has played, the following information is stored:

(i) course layout/topography information 277—which is used to provide a limited replay capability on replay unit 260, even when no CD ROM 264 is available for the particular course;

(ii) information 278 concerning the pars, course records, etc. for each hole on the course; and, (iii) player history information 279 for previous games played on the particular course;

(iv) player history information 279 may also contain the results of simultaneous games engaged in during the play of actual golf, including betting or wagering, tournament play, and the like; and (v) optionally, player history information 279 may also include the results of individual shots (including distance and trajectory) attempted by the golfer, wherein the golf computer can "learn" the capabilities of each golfer, and can serve as an electronic "caddie", by suggesting to the golfer which club he should use, and what the result of using that club is likely to be. Further, with this feature enabled, the golf computer can assess the standing of the golfer in any tournament, and can determine when high risk shots (i.e., high risk for that particular golfer) should be attempted, such as on the 18th hole, when the golfer may be compelled to make a birdie to win, and only one particular relatively high risk, shot will accomplish that.

Figure 21:
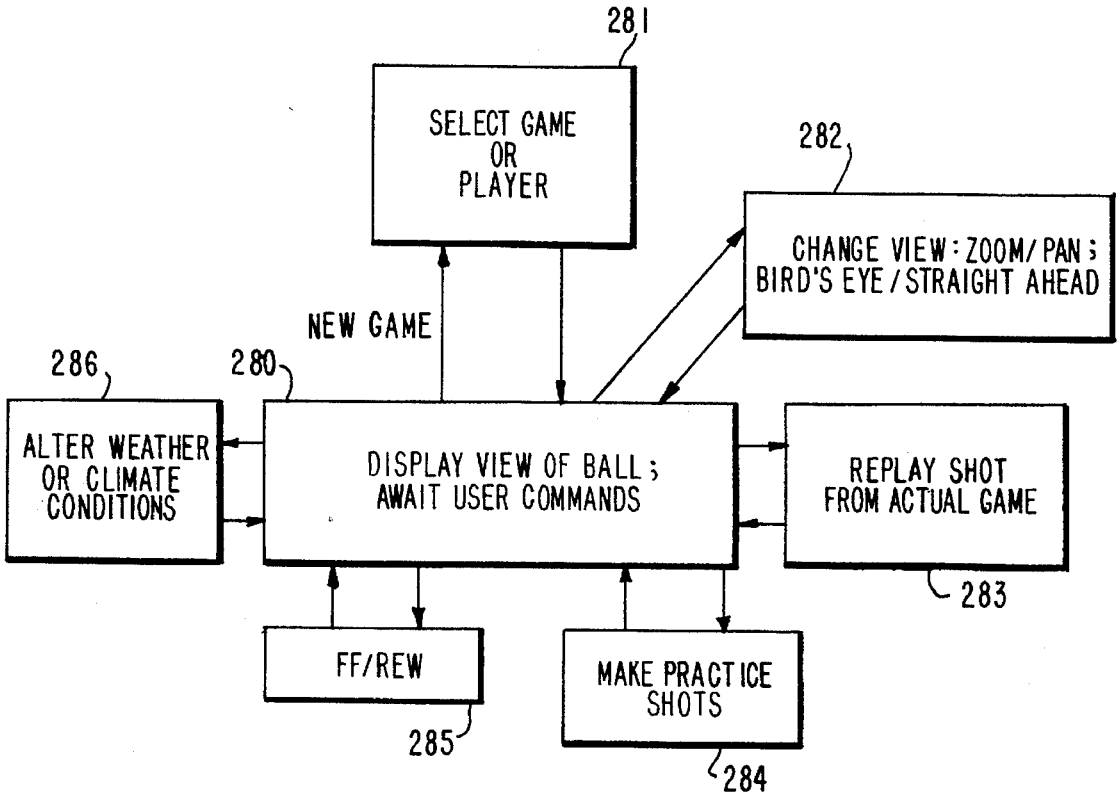
FIG. 21 is a state diagram illustrating the operation of the home-based replay unit in its REPLAY mode.

Reference is now made to FIG. 21, which is a state diagram depicting the operation of replay unit 260 in its REPLAY mode. In state 281 of the REPLAY mode, the player utilizes screen menus to select a particular player and/or a given game from memory module 15 for replay. If the player does not select a given game, then it is assumed that the selected player will play a hypothetical game. If a given game is selected, the player can then replay the selected game stroke-by-stroke.

Display state 280 is the "normal" state to which the replay unit returns after executing any of functions 281–286. In state 280, the screen displays a portion of the golf course surrounding the present position of the ball. The player can execute a change view command 282 in order to select an appropriate magnification—i.e., whole, approach or green—and to select an appropriate perspective—i.e., straight ahead or bird's eye. After selection of the desired view, the replay unit returns to the display state.

The player may execute a replay shot command 283 to view, on the screen, a recreation of the actual shot made by the player during the recorded game. If desired, the player may also request that the replay unit display, for comparative purposes, the "average" shot that the given player has made under similar conditions in the past (using the same club/stroke). After completion of the replay shot command 284, the position of the ball is updated and the replay unit returns to display state 280.

From a given position on the course, the player may invoke the practice shot command 284 to view the predicted results of hypothetical shots, using, for instance, different clubs or swings. This unique feature allows the player, at home, to experiment with alternative approaches to actual game situations. Because the practice shot feature simulates the actual—and learned—stroke capabilities of the particular player, the player may improve his own strategic approach to a given course during idle time at home. After completing the practice shot, the replay unit returns to display state 280.

A FF/REW function allows a user to quickly advance the ball to a later or earlier shot in the recorded game.

Generally, when simulating practice shots, the replay unit will assume the same weather and climate conditions as were present on the day the actual game was played. This, however, can be changed using the alter conditions command 286. By using this feature, the player may explore the effects of the prevailing weather/climate conditions on his/her previous game.

Figure 22:
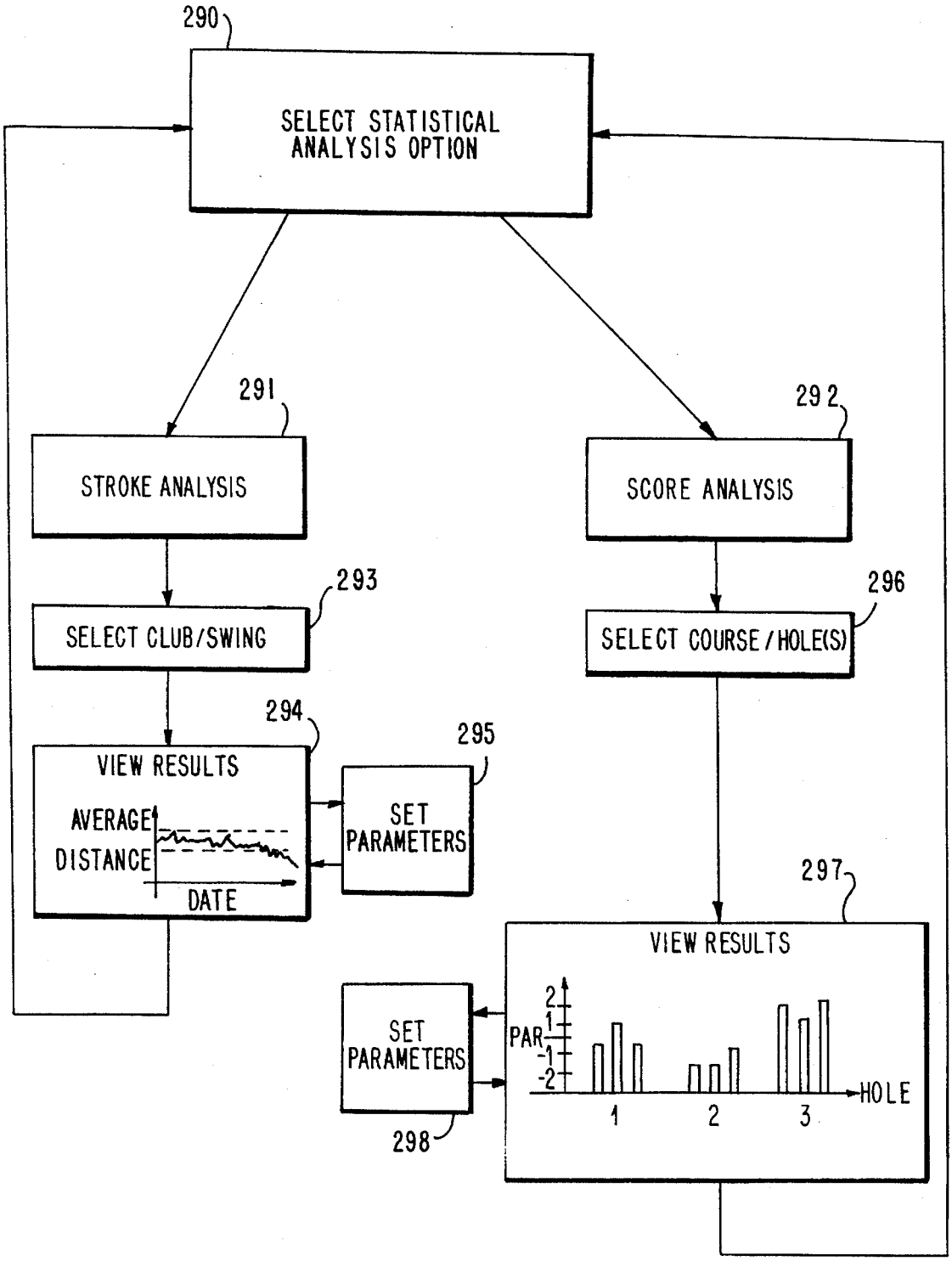
FIG. 22 is a state diagram illustrating the operation of the home-based replay unit in its ANALYSIS mode; and, FIG. 23 is a state diagram illustrating the operation of the shot suggestion module of the cart-based golf computer.

Reference is now made to FIG. 22, which is a state diagram illustrating the operation of the home-based replay unit in its ANALYSIS mode. In this mode, the player can selectively display various charts of his/her golfing performance, thereby permitting meaningful analysis of trends in the player's stroke lengths, consistencies and scores. When performing statistical analysis, the first step 290 is selecting a mode: (i) stroke analysis 291 or (ii) score analysis 292.

Stroke analysis permits the user to view his/her performance— in terms of distance and consistency—as reflected by the records of past games stored in memory module 15. Typically, the player first selects—in step 293—a particular club and, if applicable, the type of swing for analysis. The replay unit then retrieves and compiles the data from past games in which the player used the selected club/swing. The compiled data is the plotted—in step 299—and displayed on the screen. A parameter change command 295 allows the player to select among various display options, including: (i) bar charts; (ii) time-series charts; and (iii) variance analysis charts—for analyzing shot consistency. Such charts greatly aid the player by quickly revealing any drop-offs in the range of certain shots, as well as which shots in the player's game are the least consistent and warrant particular attention during practice.

Score analysis 292 allows a player to view and analyze his/her history and scoring trends on a particular course or selected holes on a given course. In step 296, the player selects the course and, if desired, the particular hole(s) for analysis. The replay unit then compiles the data regarding the player's past performance on the selected course and/or hole(s). In step 297, the replay unit displays the compiled data in one of a variety of available graphical charts. A set parameters command 298 allows the player to select among various display options, including: (i) bar charts; (ii) time-series charts; (iii) variance charts; and (iv) charts comparing the player's scores to the relevant par values and/or course records. Using these charts, the player can quickly identify his/her particular areas of weakness and/or inconsistency on the course, and also whether these identified weaknesses have recently changed.

Figure 23:
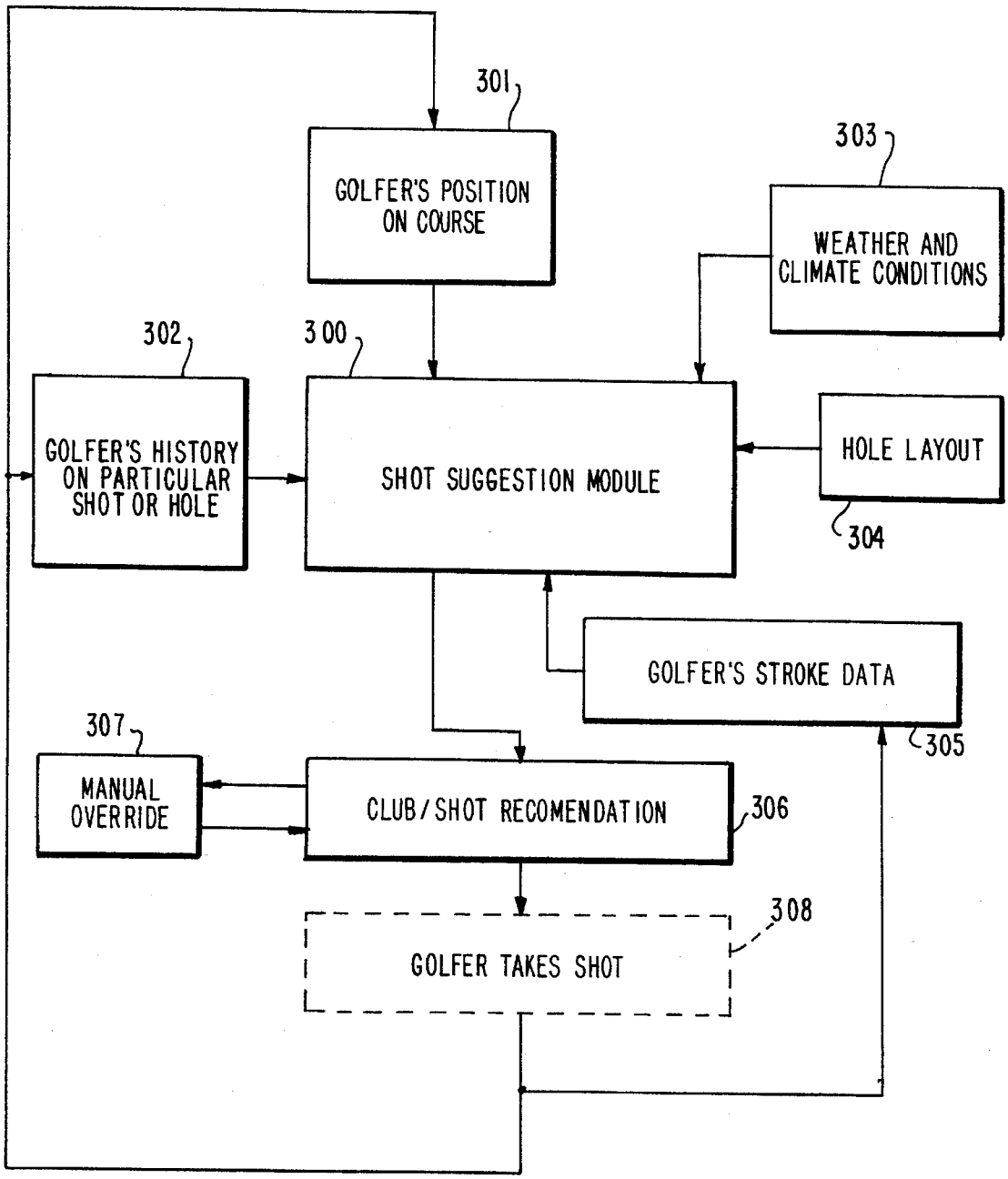

Reference is now made to FIG. 23, which is a state diagram illustrating the operation of the shot suggestion module 300 of the cart-based golf computer. As depicted, shot suggestion module 300 receives and weighs the following inputs in deriving a suggested shot for a given situation:

(i) the golfer's position 301 on the course;

(ii) the presently prevailing weather and climate conditions 303;

(iii) the layout 304 of the particular hole, including any slopes;

(iv) stroke data 305 derived and compiled from the golfer's past games; and, if available, (v) data 302 regarding the golfer's particular history on the given shot or hole.

Each of the above-enumerated factors is reduced to some numerical form compatible with the particular optimization algorithm or technique utilized by shot suggestion module 300. Various options for implementing the shot suggestion module—mathematical optimization algorithms, heuristic algorithms, neural networks, fuzzy logic, etc.—are discussed in detail below. From an overall functional perspective, however, the representation of data flow in FIG. 23 remains the same.

After considering all of the relevant inputs, suggestion module 300 displays (and/or annunciates via speaker 42) suggestions to the golfer. If desired, the golfer may issue a manual override 307.

Feedback represents the key to the golf computer's "learning" process. FIG. 23 shows the basic feedback paths. After the golfer takes a shot 308, the new position of the ball is received by the golf computer 301, which updates the display, etc. accordingly. In addition, however, the results of the shot are used to update the parameters 302 which reflect the golfer's history on the particular course or hole, as well as to update the parameters 305 which characterize the golfer's stroke capabilities. The methods by which these updates are made depend upon the particular technique used to implement shot suggestion module 300. Several appropriate update techniques—described in the Implementation section below— are known and available to those skilled in the art, to accurately and automatically determine the precise position of a golfer on any hole of a golf course. Further, methods and apparatus exist to chart the exact trajectory of each and every golf shot. In that manner, the golf computer 14 can "learn" how each golfer hits each golf club. For example, if a golfer has to hit the ball to travel over a tree that is forty foot in height, and then beyond (in the same shot) a 130 yard wide stream, the golf computer 14 can recommend to the golfer what club he must use, and can even inform the golfer of less risky alternatives, and his relative chance of success for each. Further, the golf computer 14 can inform the golfer that the shot presently being attempted has never been successfully made by that golfer, but that another member of the foursome has made the shot before, or that unless the golfer can in fact make the shot, he is likely to lose the tournament, given the scoring to that point. Thus, the golf computer 14 of the present invention can help the golfer decide what risks to take, and how much risk may be necessary given the golf score at that instant in time, and given the results of any wagering that may have taken place. As well, the golf computer can back its recommendations up with percentages and reports from previous games or shots.

Implementation of Particular Subsystems and Optional Features Doppler Radar

Various methods and apparatus have been devised for measuring characteristics of the motion of an object, such as velocity, estimated distance the object will travel ("carry distance"), spin, momentum, and trajectory. Radar devices have been developed which utilize the Doppler frequency shift to measure the velocity of the moving object. Very briefly, electromagnetic energy, such as microwave radar energy, which is transmitted toward and reflected by a moving object undergoes a frequency shift, the magnitude of which is proportional to the velocity of the object relative to the transmitter. Samples of the transmitted and reflected radiation are mixed and processed to obtain a difference signal having a frequency which is equal to the difference between the transmitted and reflected frequencies, this difference being the Doppler shift. Once the difference frequency has been obtained, the relative velocity of the object can be readily calculated.

Many Doppler radar devices count the number of pulses in the difference signal during a predetermined period of time or "window." If the width of the window (i.e., the period of time) is chosen properly, the number of pulses which are counted will equal the velocity of the object in the desired units (such as miles per hours or kilometers per hour). To determine the width of the window, it is necessary to apply the following formula:

$$f_d=(2f_tV_r)/V_c$$

where:

$f_d$ is the Doppler frequency;

$f_t$ is the frequency of the transmitted radiation;

$v_r$ is the relative velocity of the object; and $v_c$ is the velocity of light in appropriate units.

For a transmission frequency $f_t$ of about 10.5 GHz (a typical operating frequency for Doppler radar), $f_d$ equals about 31.3 $v_r$ (in miles per hour). The width of the window is the inverse of 31.3, or about 31.9 milliseconds, and the number of difference frequency pulses counted will give the object's velocity in miles per hour. For example, an object moving 100 miles per hour would produce a signal with a Doppler difference frequency of about 3,130 Hz. The number of pulses in the signal counted during a window having a width of 31.9 milliseconds is about 100, which is the velocity of the object in miles per hour.

Many Doppler radar devices employ phase lock loop (PLL) circuitry to "lock" onto the difference frequency and to generate a voltage which is proportional to the Doppler frequency. Additionally, an internal oscillator is synchronized with the frequency of the difference signal and provides an output signal at that frequency. The status of the constant voltage output can be used to determine when the PLL has locked onto the moving object (i.e. when the oscillator becomes synchronized with the difference signal). When synchronization occurs, the constant voltage output can be used to initiate the counting of pulses from the oscillator during the predetermined window.

Many Doppler radar devices employ a resistive/capacitive (RC) network in order to establish the width of the timing window. Using known equations, the values of the components in the RC network can be calculated to enable a capacitor to charge to a predetermined level, thereby activating or deactivating a counter. Precise and expensive components are necessary to provide a very accurate system. Crystal controlled timing circuits are generally more accurate but may be more expensive than an RC network and may require additional components to produce usable timing pulses.

Satellite Positioning

The Global Positioning Satellite (GPS) system includes a constellation of orbiting satellites which transmit coded information enabling a receiver-equipped observer to determine its own position and velocity. In the GPS system, each satellite utilizes the same fundamental carrier frequency to modulate its code encoded information bearing transmitted signal. The carrier frequency is first coded by a pseudo-random noise code uniquely identifying the individual satellite. A pseudo-random noise code is normally a repeating code which has random noise-like properties. In particular, the autocorrelation of a pseudo-random noise code approaches zero at all times except at zero delay.

In practice, the GPS system utilizes Gold codes, a form of pseudo-random coding, to phase modulate the carrier and spread the spectrum of the modulated information to combat interference and perform a variety of GPS-related functions. In the GPS system, each satellite transmits several Gold encoded signals. While commercial users of the GPS system generally use what are known as C/A codes, the GPS satellites also transmit a P code encoded carrier which is intended primarily for military use. The C/A Gold codes for each satellite are published, whereas the P codes which are also Gold code modulated, are restricted due to their military nature.

As mentioned above, each satellite utilizes a different Gold code as the spread spectrum C/A code. The spread spectrum carrier is modulated with an information signal containing data transmitted at 50 hertz. The differential phase shift keyed (DPSK) data is added to the spread spectrum carrier.

Accessing a GPS data stream requires a reversal of the above mentioned encoding process. Several types of information are thus derivable by decoding the spread spectrum positional signals developed by each GPS satellite. Such GPS receivers are of course known and are becoming increasingly available at reasonable prices. Such receivers conventionally utilize a code tracking loop to de-spread the spread spectrum Gold code to recover the information contained within the code. The code tracking loop further phase locks an internally generated pseudo-random noise code to the incoming code to both remove the code and to establish the propagation delay between the satellite and receiver. This propagation delay defines the pseudo-range between the satellite and receiver. This propagation delay is not determinative of actual distance or range because the repeat time of the C/A code is substantially less than the distance being measured. The C/A code repeats itself approximately once per millisecond. The transmitted signal will only propagate about 293 meters during this time and thus, the pseudo-range is the range plus or minus a multiple of 293 meters.

Once the code tracking loop is locked, the pseudo-random noise code can be removed from the satellite signal simply by mixing it with the local oscillator. The de-spread signal then passes to the carrier track loop which demodulates the satellite message by aligning the phase of the channel's local oscillator frequency with the phase of the intermediate or beat frequency. This action is commonly achieved by controlling the frequency of the voltage controlled oscillator. If the phase of the oscillation signal is not correct, a correction signal is applied to the oscillator. The carrier beat phase determines Doppler shift between the satellite and receiver indicative of the relative velocity therebetween. As mentioned above, a GPS receiver derives the pseudo-range from the received phase of the C/A code. More range precision is derivable from the carrier phase and range rate is derivable from the carrier frequency.

The track of each GPS satellite is well known and is published. Further, the information signal transmitted by the satellite describes its exact orbital location. From such orbital location information and the pseudo-range of several satellites, the position of an object on the earth's surface may be unambiguously determined. Three satellites must normally be monitored to obtain two-dimensional position with three-dimensional position being derivable from monitoring of a four satellite set.

Because multiple satellites are necessary to unambiguously determine position in a GPS system, a GPS receiver must monitor more than one satellite signal. Various combinations of multiple channel continuous tracking receivers and switching receivers using one or more hardware channels switched between satellites have been utilized.

GPS receivers have conventionally used analog processing to determine time of arrival for determining pseudo-range, carrier Doppler frequency shift, and to resolve the 50 bit per second DPSK information signal. After this information was obtained, it was digitized for computer processing of the information. Recently, there have been systems which have attempted to use digital signal processing techniques in at least part of the information acquisition process in a GPS receiver.

The Soviet Union has also implemented a spread spectrum navigation satellite system. The Soviet Union utilizes similar frequencies and data encoding technology to the American GPS system. The Soviet Union GLONASS system utilizes a single 511 bit direct sequence spread spectrum code for all satellites in the system. Each satellite, however, utilizes a unique carrier frequency which identifies the satellite. The GLONASS processing methodology is similar to that necessary for GPS. The RF signal is filtered and down converted and correlated with the matching spread spectrum sequence to collapse the information bandwidth. Because of the similarity of spread spectrum coding and transmitted frequencies, the decoding of GLONASS satellite transmitted signals may be performed in a manner substantially similar to that of GPS satellite signals.

Recently, advances in the design of GPS receivers and in integrated circuit technology have made available compact and inexpensive GPS devices compatible for incorporation into commercial products, such as the golf computer of the present invention. U.S. Pat. No. 5,271,034, entitled SYSTEM AND METHOD FOR RECEIVING AND DECODING GLOBAL POSITIONING SATELLITE SIGNALS, incorporated herein by reference, describes one such device.

While the invention has been described with reference to one or more preferred embodiments, such embodiments are merely exemplary and are not intended to be limiting or represent an exhaustive enumeration of all aspects of the invention. The scope of the invention, therefore, shall be defined solely by the following claims.

What is claimed is:

1. A portable golf computer comprising:

display means for displaying scenes representative of the geographic layout of a golf course;

memory means for storing dam representative of said scenes for each hole on the golf course;

said data stored in said memory means including data representative of three different views for each hole, including: (i) the entirety of said hole, (ii) the approach to a green associated with said hole, and (iii) the green including said hole;

locator means for automatically determining the current location of the portable computer on the golf course; and processor means, coupled to said locator means, display means and memory means, for causing said display means to display a selected one of said three views and data of the particular hole as determined by its current location on the golf course.

2. A portable golf computer as defined in claim 1, further comprising input means coupled to said processor means.

3. A portable golf computer as defined in claim 2, wherein said input means comprises a keyboard or keypad.

4. A portable golf computer as defined in claim 2, wherein said input means comprises a cursor pointing device.

5. A portable golf computer as defined in claim 2, wherein said input means includes means for inputting stroke data to said computer.

6. A portable golf computer as defined in claim 2, wherein said input means includes means for inputting betting data to said computer.

7. A portable golf computer as defined in claim 2, wherein said input means includes means for inputting wind speed or direction to said computer.

8. A portable golf computer as defined in claim 2, wherein said input means includes means for inputting ambient temperature to said computer.

9. A portable golf computer as defined in claim 1, wherein said display means comprises a flat-panel LCD display.

10. A portable golf computer as defined in claim 1, wherein said display means includes means for displaying data indicative of the number of shots taken by a golfer.

11. A portable golf computer as defined in claim 6, wherein said display means includes means for displaying updated betting totals.

12. A portable golf computer as defined in claim 1, wherein said display means includes means for displaying commercial messages.

13. A portable golf computer as defined in claim 1, wherein said display means includes means for displaying a video image.

14. A portable golf computer as defined in claim 1, wherein said display means includes means for displaying the calculated position of a golf ball.

15. A portable golf computer as defined in claim 1, further comprising a removable and writable memory card, coupled to said processor means, wherein said portable golf computer writes data to said memory card during or after a game of golf.

16. A portable golf computer as defined in claim 15, wherein said removable memory card stores scoring and betting data.

17. A portable golf computer as defined in claim 15, wherein said removable memory card stores scoring data from a plurality of individual games.

18. A portable golf computer comprising:

display means for displaying scenes representative of the geographic layout of a golf course;

memory means for storing data representative of a plurality of said scenes for each hole on the golf course;

position sensing means for automatically sensing the location of the portable golf computer on said golf course; and processor means, responsive to said position sensing means, for causing said display means to automatically display a particular one of the scenes for a particular hole as determined by the sensed location of the portable golf computer at said hole.

19. A portable golf computer comprising:

display means for displaying scenes representative of the geographic layout of a golf course;

memory means for storing data representative of a plurality of said scenes for each hole on the golf course;

position sensing means for sensing the location of the portable golf computer on said golf course;

processor means, responsive to said position sensing means, for causing said display means to display a particular one of the scenes for a particular hole as determined by the sensed location of the portable golf computer at said hole; and said position sensing means receives a signal from at least one earth orbiting satellite.

20. A portable golf computer as defined in claim 18, wherein said position sensing means receives a signal from at least one transmitter positioned on the golf course.

21. A portable golf computer as defined in claim 18, wherein said position sensing means receives a signal from at least one transmitter embedded in the earth.

22. A portable golf computer as defined in claim 18, wherein said position sensing means comprises:

means for determining the location of the portable golf computer on the golf course; and means for determining the location of a golfer relative to the location of said computer.

23. A portable golf computer as defined in claim 18, wherein said memory means includes data indicative of a golfer's skill for using at least one of a multiplicity of golf clubs.

24. A portable golf computer as defined in claim 23, wherein said processor means includes means to recommend the use of one of said golf clubs in response to (a) said data indicative of a golfer's skill and (b) said position sensing means.

25. A portable golf computer comprising:

memory means for storing stroke, betting, and course data;

input means for inputting said stroke and betting data;

locator means for automatically determining the location of the portable computer on the golf course;

processor means for computing, based on said stroke, betting and course dam, score(s) and betting total(s); and display means for displaying said score(s) and betting totals.

26. A portable golf computer as defined in claim 25, wherein said input means comprises a keyboard or keypad.

27. A portable golf computer as defined in claim 25, wherein said input means comprises a cursor pointing device.

28. A portable golf computer comprising:

memory means for storing stroke, betting, and course data;

input means for inputting said stroke and betting data;

processor means for computing, based on said stroke, betting and course data, score(s) and betting total(s); and said memory means also stores individual player handicap data.

29. A portable golf computer as defined in claim 28, wherein said processor means uses said handicap data in computing said score(s) and betting total(s), and further comprises means to update said handicap data.

30. A portable golf computer as defined in claim 25 wherein said memory means is removable.

31. A portable golf computer as defined in claim 30 wherein said memory means is readable by a central computer suitable for tracking the performance of multiple golfers.

32. A portable golf computer as defined in claim 25 wherein an element contained within said memory means is transferable to at least one remote site by infrared radiation.

33. A portable golf computer as defined in claim 25 wherein an element contained within said memory means is transferable to at least one remote site by a wireless data link.

34. A portable golf computer as defined in claim 25 wherein an element contained within said memory means is transferable to at least remote site by luminescent radiation.

35. A portable golf computer as defined in claim 25 wherein an element contained within said memory means is transferable to at least one remote site by an energy pathway.

36. A golf replay apparatus comprising:

a portable golf computer means for use on a golf course for recording information of an individual player's actual performance while a player plays a game of golf on the golf course; and a replay means, responsive to said recorded information, for interactively reenacting said game of golf on an electronic display including, means for using an alternate club for at least one stroke and determining the potential effect of such change on the previously played actual performance on the golf course;

said replay means altering the result of the player's performance on the hole for which an alternate club has been selected while retaining the player's prior performance on all previously and subsequently played holes.

37. A portable golf computer as defined in claim 1, wherein said locator means receives a signal from at least one earth orbiting satellite.

38. A portable golf computer for indicating the user's location on a golf course, comprising:

display means for displaying information representative of the layout of a selected individual hole of a golf course;

means for inputting the daily tee positions at each hole of the golf course;

memory means for storing data representative of a plurality of parameters for each hole on the golf course, including the daily tee positions;

position sensing means which receives a signal from at least one earth orbiting satellite for automatically determining the location of the portable golf computer on the golf course; and processor means, responsive to said position sensing means, for causing said display means to display information of said individual hole as referenced to the automatically determined current location of the user on the golf course.

39. A portable golf computer as defined in claim 38, wherein said display means indicates approaching topographical hazards along the selected hole, and the distance to said hazards.

40. A portable golf computer as defined in claim 38, further including means to formulate the user's route of successive strokes to reach the green from the automatically determined current location.

41. A portable golf computer as defined in claim 38, further including means for inputting individual player information into said memory means.

42. A portable golf computer as defined in claim 41, further including means to formulate the individual player's route of successive strokes to reach the green, based on the individual player's skills and automatically determined current location.

43. A portable golf computer as defined in claim 38, further including means for inputting the daily cup positions.

44. A portable golf computer as defined in claim 38, further including means for measuring wind speed or direction and inputting same to said processor means.

45. A portable golf computer as defined in claim 38, further including means for measuring ambient temperature and inputting same to said processor.

46. A portable golf computer as set forth in claim 42, further including club selection means for advising the player of the specific golf club to be used while following the formulated route for the individual player.

47. A portable golf computer as set forth in claim 46, further including means for measuring wind speed or direction and inputting same to said processor means, and wherein said club selection means is adjusted for the measured wind speed or direction.

48. A portable golf computer as set forth in claim 46, further including means for measuring ambient temperature and inputting same to said processor, and wherein said club selection means is adjusted for the measured ambient temperature.

49. A mobile computer affixed to a movable object for indicating the current location of said movable object within a golf course, comprising:

a GPS receiver carried by said movable object as it traverses about the golf course;

said GPS receiver adapted to receive signals from a plurality of earth orbiting satellites within the GPS system and processing said signals to accurately determine its current location within the golf course, means for inputting and updating individual player's performance, and said mobile computer further including means for communicating player's performance and its GPS determined current location.

50. A mobile computer as defined in claim 49 wherein said movable object is a golf cart.

51. A mobile computer as defined in claim 50, wherein said means for communicating current location includes a visual display means.

52. A mobile computer as set forth in claim 49, further including a wireless link to a central location.

53. A method for providing a golf course visual display which includes the current location of a movable object on the golf course and assists the golfer's performance on the golf course, including the steps of:

affixing a GPS receiver to the movable object;

processing signals received by the GPS receiver from a plurality of earth orbiting satellites within the GPS system to accurately determine its current location within the golf course;

presenting the current location to a processor means;

presenting the processor means with information representative of the individual player's skill;

communicating the current location of the movable object to a visual display;

processing the information presented to the processor to provide the player with assistance for completing played on the then being play particular hole; and modifying the visual display to display information including assistance for completing play on the particular hole from the current location of the movable object.

54. A portable golf computer comprising:

display means for displaying scenes representative of the geographic layout of a golf course;

memory means for storing data representative of said scene for each hole on the golf course;

said data stored in said memory means including data representative of different locations for each hole, including: (i) the entirety of said hole, (ii) the distance on the fairway between the current location and the hole and (iii) the green including said hole;

locator means which operates in conjunction with a signal means above the surface of and external of the fairway of the hole being played for determining the current location of the portable computer on the golf course; and processor means, coupled to said display means, locator means and memory means, for causing said display means to display a selected one of the scenes of a particular hole which is representative of the geographic layout of the golf course, as determined by the current location of the portable computer on the golf course in conjunction with data representative of the current location on the particular hole.

* * * * *

UNITED STATES PATENT AND TRADEMARK OFFICE

CERTIFICATE OF CORRECTION

PATENT NO. : 5,507,485
APPLICATION NO. : 08/234420
DATED : April 16, 1996
INVENTOR(S) : Donald Fisher It is certified that error appears in the above-identified patent and that said Letters Patent is hereby corrected as shown below:

Column 15, line 55 claim 1, change “dam” to --data--.

Column 17, line 39 claim 25, change “dam” to --data--.

Signed and Sealed this

Third Day of June, 2008

JON W. DUDAS
*Director of the United States Patent and Trademark Office*

US005507485C1

(12) EX PARTE REEXAMINATION CERTIFICATE (7181st)

United States Patent

Fisher

(10) Number: US 5,507,485 C1

(45) Certificate Issued: Nov. 24, 2009

(54) GOLF COMPUTER AND GOLF REPLAY DEVICE

(75) Inventor: Donald Fisher, Roslyn, NY (US)

(73) Assignee: Roblor Marketing Group, Inc., New York, NY (US)

Reexamination Request:
No. 90/010,248, Aug. 19, 2008

Reexamination Certificate for:

| | |
|---|---|
| Patent No.: | **5,507,485** |
| Issued: | **Apr. 16, 1996** |
| Appl. No.: | **08/234,420** |
| Filed: | **Apr. 28, 1994** |

Certificate of Correction issued Jun. 3, 2008.

(51) Int. Cl.

| | |
|---|---|
| ***A63B 69/36*** | (2006.01) |
| ***A63B 71/06*** | (2006.01) |
| ***G01S 5/14*** | (2006.01) |
| ***G09B 19/22*** | (2006.01) |

(52) U.S. Cl. ..... 473/407; 473/131; 700/91

(58) Field of Classification Search ..... None
See application file for complete search history.

(56) References Cited

U.S. PATENT DOCUMENTS

| | | | | |
|---|---|---|---|---|
| 5,245,537 A | * | 9/1993 | Barber | 473/403 |
| 5,319,548 A | | 6/1994 | Germain | |
| 5,364,093 A | | 11/1994 | Huston et al. | |

FOREIGN PATENT DOCUMENTS

GB 2249202 A1 4/1992

OTHER PUBLICATIONS

"Eagle Scoremaster Golf Computer Easy to Use! Operating Instructions", published 1981, 33 pages.

* cited by examiner

*Primary Examiner*—Peter C. English

(57) ABSTRACT

A portable computer to facilitate the game of golf is programmed to record a golfer's score and keep track of various shots and the results of related wagering. Based upon such data and data regarding the layout of the golf course, the computer can provide real time recommendations for club selection as well as providing a summary of the results of a round of golf. Also, the computer can receive global positioning system (GPS) signals to locate a golf ball within a golf course.

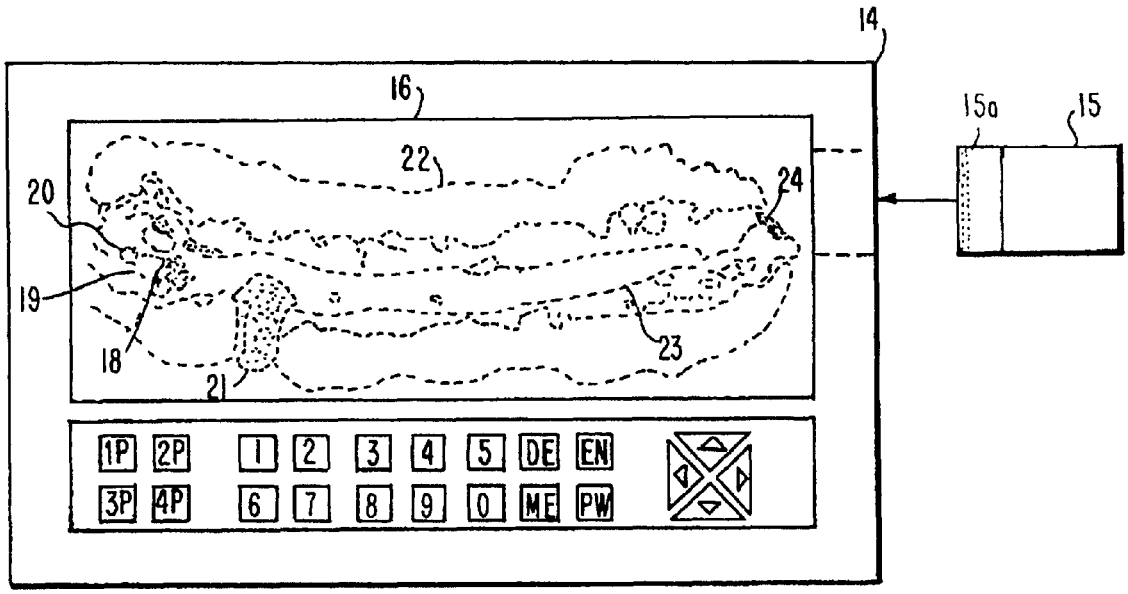

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–35, 37 and 54 is confirmed.

Claims 38, 40, 42, 49 and 53 are determined to be patentable as amended.

Claims 39, 41, 43–48 and 50–52, dependent on an amended claim, are determined to be patentable.

Claim 36 was not reexamined.

38. A portable golf computer for indicating the user's location on a golf course, comprising:

display means for displaying information representative of the layout of a selected individual hole of a golf course;

means for inputting the daily tee positions at each hole of the golf course;

memory means for storing data representative of a plurality of parameters for each hole on the golf course, including the daily tee positions*, and for storing data representative of a plurality of scenes for each hole on the golf course*;

position sensing means which receives a signal from at least one earth orbiting satellite for automatically determining the location of the portable golf computer on the golf course; and processor means, responsive to said position sensing means, for causing said display means to display [information of said individual hole] *a particular one of the plurality of scenes for a particular hole* as referenced to the automatically determined current location of the user on the golf course.

40. A portable golf computer [as defined in claim 38, further including] *for indicating the user's location on a golf course, comprising:*

*display means for displaying information representative of the layout of a selected individual hole of a golf course;*

*means for inputting the daily tee positions at each hole of the golf course;*

*memory means for storing data representative of a plurality of parameters for each hole on the golf course, including the daily tee positions;*

*position sensing means which receives a signal from at least one earth orbiting satellite for automatically determining the location of the portable golf computer on the golf course;*

*processor means, responsive to said position sensing means, for causing said display means to display information of said individual hole as referenced to the automatically determined current location of the user on the golf course; and* means to formulate the user's route of successive strokes to reach the green from the automatically determined current location.

42. A portable golf computer [as defined in claim 41, further including] *for indicating the user's location on a golf course, comprising:*

*display means for displaying information representative of the layout of a selected individual hole of a golf course;*

*means for inputting the daily tee positions at each hole of the golf course;*

*memory means for storing data representative of a plurality of parameters for each hole on the golf course, including the daily tee positions;*

*position sensing means which receives a signal from at least one earth orbiting satellite for automatically determining the location of the portable golf computer on the golf course;*

*processor means, responsive to said position sensing means, for causing said display means to display information of said individual hole as referenced to the automatically determined current location of the user on the golf course;*

*means for inputting individual player information into said memory means; and* means to formulate the individual player's route of successive strokes to reach the green, based on the individual player's skills and automatically determined current location.

49. A mobile computer affixed to a movable object for indicating the current location of said movable object within a golf course, comprising:

a GPS receiver carried by said movable object as it traverses about the golf course;

said GPS receiver adapted to receive signals from a plurality of earth orbiting satellites within the GPS system and processing said signals to accurately determine its current location within the golf course,

*memory means for storing data representative of a plurality of scenes for each hole on the golf course;* means for inputting and updating individual player's performance, [and said mobile computer further including] *display* means for communicating player's performance and [its] *said mobile computer's* GPS determined current location*; and*

*processor means, responsive to said GPS receiver, for causing said display means to display a particular one of the scenes for a particular hole in correspondence to the determined current location.*

53. A method for providing a golf course visual display which includes the current location of a movable object on the golf course and assists the golfer's performance on the golf course, including the steps of:

affixing a GPS receiver to the movable object;

processing signals received by the GPS receiver from a plurality of earth orbiting satellites within the GPS system to accurately determine its current location within the golf course;

*retrieving data representative of a plurality of scenes for each hole on the golf course, from a memory;* presenting the current location to a processor means;

presenting the processor means with information representative of the individual player's skill;

communicating the current location of the movable object to a visual display;

processing the information presented to the processor to provide the player with assistance for completing [played] *play* on the then being [play] *played* particular hole; and

*automatically* modifying the visual display [to], *in response to the determined location, to* display [information] *a particular one of the plurality of scenes for a particular hole* including assistance for completing play on the particular hole from the current location of the movable object.

* * * * *

US005507485C2

(12) EX PARTE REEXAMINATION CERTIFICATE (8158th)

United States Patent

Fisher

(10) Number: US 5,507,485 C2

(45) Certificate Issued: Apr. 12, 2011

(54) GOLF COMPUTER AND GOLF REPLAY DEVICE

(75) Inventor: Donald Fisher, Roslyn, NY (US)

(73) Assignee: Roblor Marketing Group, Inc., New York, NY (US)

Reexamination Request:
No. 90/009,260, Aug. 21, 2008

Reexamination Certificate for:

| | |
|---|---|
| Patent No.: | **5,507,485** |
| Issued: | **Apr. 16, 1996** |
| Appl. No.: | **08/234,420** |
| Filed: | **Apr. 28, 1994** |

Reexamination Certificate C1 5,507,485 issued Nov. 24, 2009

Certificate of Correction issued Jun. 3, 2008.

(51) Int. Cl.

| | |
|---|---|
| ***A63B 69/36*** | (2006.01) |
| ***A63B 71/06*** | (2006.01) |
| ***G01S 5/14*** | (2006.01) |
| ***G09B 19/22*** | (2006.01) |

(52) U.S. Cl. ..... 473/407; 473/131; 700/91

(58) Field of Classification Search ..... None
See application file for complete search history.

(56) References Cited

U.S. PATENT DOCUMENTS

| | | | |
|---|---|---|---|
| 3,868,692 | A | 2/1975 | Woodard et al. |
| 4,136,394 | A | 1/1979 | Jones et al. |
| 4,590,569 | A | 5/1986 | Rogoff et al. |
| 4,698,781 | A | 10/1987 | Cockerell, Jr. |
| 4,703,444 | A | 10/1987 | Storms, Jr. et al. |
| 4,751,512 | A | 6/1988 | Longaker |
| 4,819,053 | A | 4/1989 | Halavais |
| 4,893,127 | A | 1/1990 | Clark et al. |
| 4,939,661 | A | 7/1990 | Barker et al. |
| 4,949,089 | A | 8/1990 | Ruszkowski |
| 5,025,261 | A | 6/1991 | Ohta et al. |
| 5,044,634 | A | 9/1991 | Dudley |
| 5,046,839 | A | 9/1991 | Krangle |
| 5,056,106 | A | 10/1991 | Wang et al. |
| 5,075,693 | A | 12/1991 | McMillan et al. |
| 5,095,430 | A | 3/1992 | Bonito et al. |
| 5,148,179 | A | 9/1992 | Allison |
| 5,163,004 | A | 11/1992 | Rentz |
| 5,202,829 | A | 4/1993 | Geier |
| 5,220,507 | A | 6/1993 | Kirson |
| 5,245,537 | A | 9/1993 | Barber |
| 5,261,820 | A | 11/1993 | Slye et al. |
| 5,268,844 | A | 12/1993 | Carver et al. |
| 5,270,936 | A | 12/1993 | Fukushima et al. |
| 5,294,110 | A | 3/1994 | Jenkins et al. |
| 5,319,548 | A | 6/1994 | Germain |
| 5,364,093 | A | 11/1994 | Huston et al. |
| 5,438,518 | A | 8/1995 | Bianco et al. |
| 5,558,333 | A | 9/1996 | Kelson et al. |

FOREIGN PATENT DOCUMENTS

| | | |
|---|---|---|
| JP | 61-137088 | 6/1986 |
| JP | 62-113582 | 7/1987 |
| JP | 1-153988 | 6/1989 |
| JP | 1-221687 | 9/1989 |
| JP | 1-257287 | 10/1989 |

(Continued)

OTHER PUBLICATIONS

Van Flandern, T.C. et al., "Low–Precision Formulae for Planetary Positions," The Astrophysical Journal Supplement Series, Nov. 1979, 41:391–411, U.S.A.

(Continued)

*Primary Examiner*—Glenn K. Dawson

(57) ABSTRACT

A portable computer to facilitate the game of golf is programmed to record a golfer's score and keep track of various shots and the results of related wagering. Based upon such data and data regarding the layout of the golf course, the computer can provide real time recommendations for club selection as well as providing a summary of the results of a round of golf. Also, the computer can receive global positioning system (GPS) signals to locate a golf ball within a golf course.

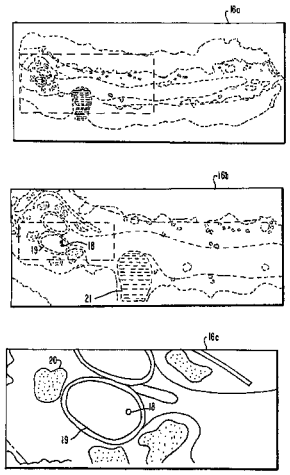

FOREIGN PATENT DOCUMENTS

| | | |
|---|---|---|
| JP | 02-107985 | 4/1990 |
| JP | 02-206900 | 8/1990 |
| JP | 03-030787 | 2/1991 |
| JP | 3-92714 | 4/1991 |
| JP | 1-272656 | 6/1991 |
| JP | 3-264081 | 11/1991 |
| JP | 04-335178 A | 11/1992 |
| JP | 6-166923 | 6/1994 |
| JP | 6-222091 | 8/1994 |

OTHER PUBLICATIONS

Beser, J. et al., "The Application of NAVSTAR Differential GPS in the Civilian Community," Navigation: Journal of The Institute of Navigation, Summer 1982, vol. 29, No. 2, pp. 107–136, U.S.A.

Kalafus, R.J. et al., "Differential Operation of NAVSTAR GPS," Navigation: Journal of The Institute of Navigation, Fall 1983, vol. 30, No. 3, pp. 187–204, U.S.A.

Leick, A., "GPS Surveying and Data Management," papers from annual conference of Urban and Regional Information Systems Association, Aug. 12–15, 1984, pp. 104–115, Seattle, WA.

Henson, D.J. et al., "Geodetic Applications of the Texas Instruments TI4100 GPS Navigator," Proceedings of the First Int'l Symposium on Precise Positioning with the Global Positioning System, Rockville, MD, Apr. 15–19, 1985, vol. I, pp. 191–200.

Goad, C.C., "Precise Positioning With the Global Positioning System," Proceedings of the Third Int'l Symposium on Inertial Technology for Surveying and Geodesy, Banff, Alberta, Canada, Sep. 16–20, 1985, pp. 745–756.

Blackwell, E.G., "Overview of Differential GPS Methods," Global Positioning System, 1986, vol. 3, pp. 89–100, The Institute of Navigation, Washington, D.C.

Thompson, S.D., Satellite Navigation With the Global Positioning System (A GPS Primer), Oct. 1987, pp. i–iv and 1–67, Interstate Electronics Corp., U.S.A.

Taylor, Keith, "Navigating on the screen with a Macintosh," SAIL Magazine, Jan. 1988, p. 64, U.S.A.

Ad for Emergency Locator Model ELP–1000, Emergency Locator Products Corp., Bayshore, NY, Apr. 1988, Petersen's Hunting Magazine, p. 52, U.S.A.

Vanicek, Petr, "Hiking and Biking With GPS: The Canadian Perspective," GPS–Techniques Applied to Geodesy and Surveying, Lecture Notes in Earth Sciences, Proceedings of the Int'l GPS–Workshop, Darmstadt, Germany, Apr. 10–13, 1988, pp. 225–229.

Harris, C.B. et al., "Digital Map Dependent Functions of Automatic Vehicle Location Systems," Jul. 1988, pp. 79–87, IEEE, U.S.A.

Ashjaee, J.M. et al., "Ashtech XII GPS Receiver, The All–In–One All–In–View," Jul. 1988, pp. 426–433, IEEE, U.S.A.

Eschenbach, Ralph, "Practical Aspects of Kinematic Surveying," Proceedings of the Satellite Division's International Technical Meeting, Colorado Springs, CO, Sep. 19–23, 1988, pp. 123–128, The Institute of Navigation, Washington, DC.

Ulman, Neil, "Computers Make Celestial Navigation Less Celestial?," The Wall Street Journal, Leisure & Arts Section, Dec. 15, 1988, U.S.A.

Barlow, Capt. David A., "NAVSTAR on the U.S. Army Battlefield," Signal Magazine, Jan. 1989, pp. 51–53, U.S.A.

Lloyd's List International, "Measurement Devices is marketing the Trimble NavGraphic Loran–C," Jan. 9, 1989, U.S.A.

Author Unknown, Trimble Navigation corporate brochure, May 1989.

Harris, C.B. et al., "AVLN 2000 Automatic Vehicle Location and Navigation System," Jun. 1989, pp. 126–130, IEEE, U.S.A.

U.S. Newswire, "U.S. Air Force and Rockwell Revolutionize Navigation," Seal Beach, CA, Jun. 12, 1989, provided by ProQuest Information and Learning, U.S.A.

Ekman, A., "A New International Position Reporting Service for Maritime and Land Mobile Users," Proceedings of ION GPS–89, The Second International Technical Meeting of the Satellite Division of The Institute of Navigation, Colorado Springs, CO, Sep. 27–29, 1989, pp. 133–137, The Institute of Navigation, Washington, D.C.

Ad for Cetrek 757 Chartpilot navigational device for Cetrek Navistar, Pembroke, MA, in SAIL Magazine, Oct. 1989, p. 113, U.S.A.

Magellan Systems Corp. paragraph on its hand–held global positioning system in Aviation Week & Space Technology, Oct. 30, 1989, vol. 131, No. 18, p. 51, McGraw–Hili, Inc., U.S.A.

Article, "Miniature Satellite Receivers Spring from DARPA's Program," Signal Magazine, Feb. 1990, p. 51, U.S.A.

Author Unknown, "What is GPS?," Cruising World Magazine, Jun. 1990, pp. 67–71, Japan.

Author Unknown, "Loran or Decca?," Electronics World + Wireless World Magazine, Aug. 1990, pp. 730–734, U.S.A.

Trimble Navigation, Model 4000DL Differential Locator, Model4000RL Reference Locator—Operator Manual, Aug. 1990, Rev. A, pp. 1–2 to 1–9; 1–16 to 1–17; 3–4 to 3–5; and 5–8 to 5–9, Trimble Navigation, Ltd., Sunnyvale, CA.; and picture of device.

Author Unknown, "Navigation System Guide," RV Magazine, Aug. 1990, vol. 85, pp. 53–55, Japan.

Hughes, David, "Aviation Week Pilot Report Extensive MD–11 Automation Assists Pilots, Cuts Workload," Aviation Week & Space Technology, Oct. 23, 1990, vol. 133, No. 17, p. 34, U.S.A.

Trade Show report on Magellan Navstar GPS systems in Yachting World Magazine, Dec. 1990, p. 81, U.S.A.

Krage, M.K., "The TravTek Driver Information System," General Motors Research Labs., No. 912820, 1991, pp. 739–748 and Figures, U.S.A.

Ad for Magellan NAV 1000 Plus GPS receiver in Popular Science Magazine, Feb. 1991, p. 18, U.S.A.

Pitiman, Freeman, "Never Before Seen," SAIL Magazine, Mar. 1991, pp. 78–79, U.S.A.

Ad for Magellan NAV 1000 Plus GPS in SAIL Magazine, May 1991, U.S.A.

Korane, K.J., "Electronics Makes Boating Safer, More Fun," Machine Design, Jun. 6, 1991, Penton Publishing Inc., U.S.A.

Author Unknown, "GPS," Nikkei Mechanical, Inside section article on Sony PYXIS, Sep. 30, 1991, pp. 132–135, Japan.

Author Unknown, "GPS," (re Sony PYXIS and NAV1000), Cruising World, Oct. 1991, pp. 58–65, Japan.

Ad for Echotec's CTM–900G Plotter/GPS System, Echotec, Inc., Woodinville, WA, SAIL MAgazine, Oct. 1991, p. 91, U.S.A.

Albert, Daniel, "Sail by wire," Popular Science, Nov. 1991, U.S.A.
Declaration of Gaylord Green, May 10, 1996.
Documentation of Trimble Navigation Trimpack GPS device, Jun. 19, 2001, Geodetic Reserach Laboratory, Dept. of Geodesy and Geomatics Eng., Univ. of New Brunswick, Canada.
David Wells, Guide to GPS Positioning, Canadian GPS Associates, Dec. 1986.
Trimble Navigation, Corporate Brochure, 1988.
Magellan, Advertisement for GPS NAV 1000, Sail Magazine, Jun. 13, 1989, Issue: Jul. 1989.
Laurence Hooper and Jacob M. Schlesinger, Precise Navigation Points to New Worlds, The Wall Street Journal, Mar. 4, 1991, p. B1.
Trimble Navigation, Advertisement for TransPak, Sail Magazine, Issue: Jul. 1991.
Magellan, Advertisement for GPS NAV 1000, Sail Magazine, Issue: Oct. 1988.
Raytheon, Advertisement for RAYSTAR 590 GPS, Yachting World Magazine, Issue: Feb. 1991.
Tecom Industries, Advertisement for NAV–STAR, Sailing World Magazine, Issue: Jun. 1991.
Philips, On the Right Track, Electronics World Wireless World. Issue: Apr. 1991.
Patent File History for U.S. Appl. No. 08/759,081.
DA Brushnighan, MG Strauss, JM Floyd and BC Wheeler, Orientation Aid Implementing the Goobal Positioning System, IEEE 1989, pp. 33–34.
Breck W. Henderson, Military Electronics Ground Forces Rely on GPS to Navigate Desert Terrain, Aviation Week, Feb. 11, 1991, vol. 134, No. 6, p. 77.
George Lowenstein, John Phanos, and Edward Rish, Sole Means Navigation in U.S. Navy Aircraft, IEEE AES Magazine, Aug. 1988, pp. 16–22.
Neil Ackroyd and Robert Lorimer, Global Navigation—A GPS User's Guide, Jun. 14, 1990, Lloyd's of London Press LTD., pp. 26–41.
Jeff Hurn, GPS—A Guide to the Next Utility, 1989 Trimble Navigation LTD., pp. 58–61.
Radio Technical Commission for Maritime Services, RTCM Recommended Standards for Differential NAVSTAR GPS Service, Jan. 1, 1990, RTCM Special Committee, pp. 2–1 to 2–5.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-54 is confirmed.

* * * * *